US006178302B1

(12) United States Patent
Nagashima et al.

(10) Patent No.: US 6,178,302 B1
(45) **Date of Patent: *Jan. 23, 2001**

(54) DEVELOPER CONTAINER SEAL, DEVELOPER CONTAINER, DEVELOPING APPARATUS, PROCESS CARTRIDGE, AND IMAGE FORMING APPARATUS

(75) Inventors: Toshiaki Nagashima, Mishima; Teruhiko Sasaki, Toride; Kazuo Chadani, Suntoh-gun; Toru Koizumi, Toride, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/207,025

(22) Filed: Dec. 8, 1998

(30) Foreign Application Priority Data

Dec. 9, 1997 (JP) ..... 9-356286
Nov. 30, 1998 (JP) ..... 10-339505

(51) Int. Cl.[7] ..... G03G 15/08

(52) U.S. Cl. ..... 399/106; 399/111; 399/119

(58) Field of Search ..... 399/106, 102, 399/103, 105, 119, 111, 262; 222/DIG. 1

(56) References Cited

U.S. PATENT DOCUMENTS

| | | | | |
|---|---|---|---|---|
| 4,931,838 | | 6/1990 | Ban et al. | 399/106 |
| 4,998,140 | | 3/1991 | Satou et al. | 355/145 |
| 5,177,540 | * | 1/1993 | Honda et al. | 399/106 |
| 5,491,542 | | 2/1996 | Nagashima et al. | 399/106 |
| 5,585,902 | * | 12/1996 | Nishiuwatoko et al. | 399/106 |
| 5,752,131 | * | 5/1998 | Fujiwara et al. | 399/106 |
| 5,778,282 | | 7/1998 | Nagashima | 399/106 |
| 5,920,753 | | 7/1999 | Sasaki et al. | 399/111 |

FOREIGN PATENT DOCUMENTS

| | | |
|---|---|---|
| 0 788 033 A1 | 8/1997 | (EP) . |
| 3-31877 | 2/1991 | (JP) . |
| 3-98460 | 10/1991 | (JP) . |
| 4-61367 | 5/1992 | (JP) . |
| 5-15064 | 2/1993 | (JP) . |
| 8-314351 | 11/1996 | (JP) . |
| 8-328369 | 12/1996 | (JP) . |
| 9-6214 | 1/1997 | (JP) . |
| 9-197945 | 7/1997 | (JP) . |
| 11-184320 | 7/1999 | (JP) . |

OTHER PUBLICATIONS

Patent Abstracts of Japan, P–1599, English Abstract of Japanese patent No. 5–107917, published Apr. 30, 1993.

Patent Abstracts of Japan, vol. 1997, No. 3, Mar. 31, 1997 & JP 8–314351.

Patent Abstracts of Japan, vol. 1997, No. 3, Mar. 31, 1997 & JP 8–305260.

* cited by examiner

*Primary Examiner*—Fred L. Braun
*Assistant Examiner*—Hoan Tran
(74) *Attorney, Agent, or Firm*—Fitzpatrick, Cella, Harper & Scinto

(57) ABSTRACT

A seal member for sealing an opening of a developer accommodating container for accommodating a developer, which developer accommodating container is detachably mountable to a main assembly of an image forming apparatus, includes a seal base for sealing the opening; a force receiving portion for receiving a force for unsealing the seal base; an electroconductive portion capable of being disconnected by an unsealing operation of the seal base, the electroconductive portion including a contact portion electrically connectable with a contact portion of the main assembly of the image forming apparatus to permit the main assembly of the image forming apparatus to detect whether the electroconductive portion is disconnected or not.

98 Claims, 18 Drawing Sheets

DEVELOPER CONTAINER SEAL, DEVELOPER CONTAINER, DEVELOPING APPARATUS, PROCESS CARTRIDGE, AND IMAGE FORMING APPARATUS

FIELD OF THE INVENTION AND RELATED ART

The present invention relates to a seal for sealing the opening of a developer container employed by a copying machine, a printer, or the like. It also relates to a developing container, a developing apparatus, a process cartridge, and an image forming apparatus.

A container for storing developer has been employed in an electrophotographic apparatus, for example, an image forming apparatus, and more specifically, a copying machine, a printer, or the like. This type of container is provided with an opening through which developer is discharged into a developing device. The opening is covered with a seal to prevent developer from leaking out of the container while the container filled with developer is transported. The seal is removed to expose the opening prior to the mounting of the container into the main assembly of an image forming apparatus. A developer container may constitute a part of a developing means container integral with a developing apparatus, or it may constitute a part of a process cartridge. In the latter case, the process cartridge comprises a photosensitive member as an image bearing member and a developing apparatus, and the developing apparatus integrally comprises the development container and a development device. Also in the latter case, the opening, through which developer is passed from the developer container to the developing means container, is sealed with the aforementioned seal, and then, the seal is removed, that is, the developer container is unsealed, prior to the mounting of the process cartridge into an image forming apparatus.

If a developer container is mounted into an image forming apparatus without removing the seal, image formation becomes impossible. Therefore, it has been desired to automatically detect whether or not the seal has been removed, and in particular, in the case of an image forming apparatus in which the seal is automatically removed, after the mounting of a developer container into the image forming apparatus. This is because when a developer container, which has been unseal, is mounted into an image forming apparatus, removal of the seal is unnecessary. Detection of whether or not the seal has been removed has an additional advantage in that the detection is analogous to detection of whether or not the developer container is brand new, and therefore, the detection makes it possible to accurately determine when the developer container is to be replaced next time; in other words, when a developer container constitutes a part of a process cartridge, it is possible to accurately determine when the process cartridge should be replaced.

Further, it has been desired that such a detection capability is inexpensive.

SUMMARY OF THE INVENTION

The primary object of the present invention is to provide a means for detecting whether or not a toner seal designed to be automatically removed has been removed.

Another object of the present invention is to provide an inexpensive means for accurately detecting whether or not a toner seal has been removed.

Another object of the present invention is to provide a means for detecting whether or not a developer container, which has just been mounted in an image forming apparatus main assembly, is brand new.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Figure 1:
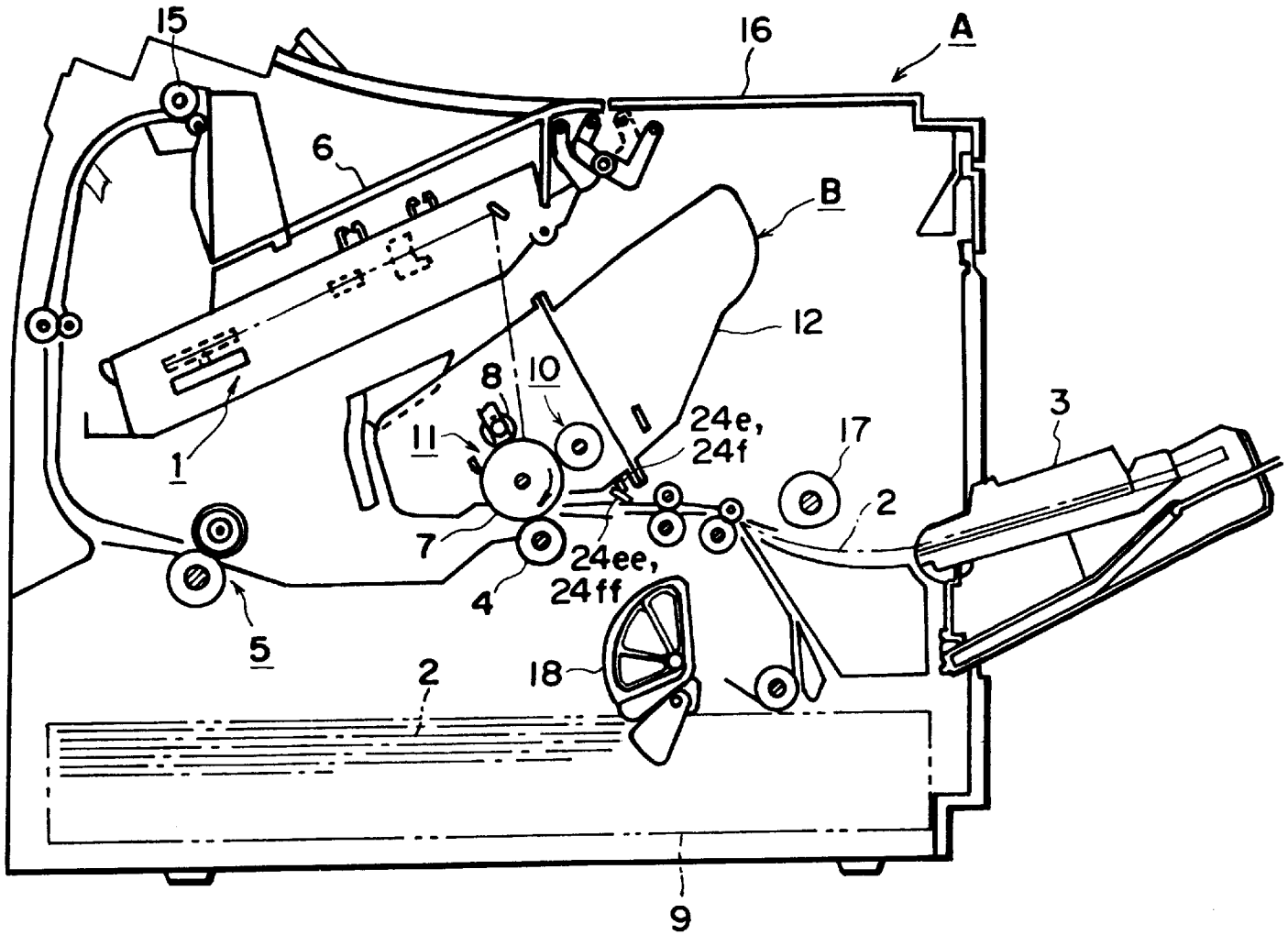
FIG. 1 is a vertical section of an image forming apparatus in the first embodiment of the present invention, and illustrates the locations and structures of the electrical contact points in the image forming apparatus.
Figure 2:
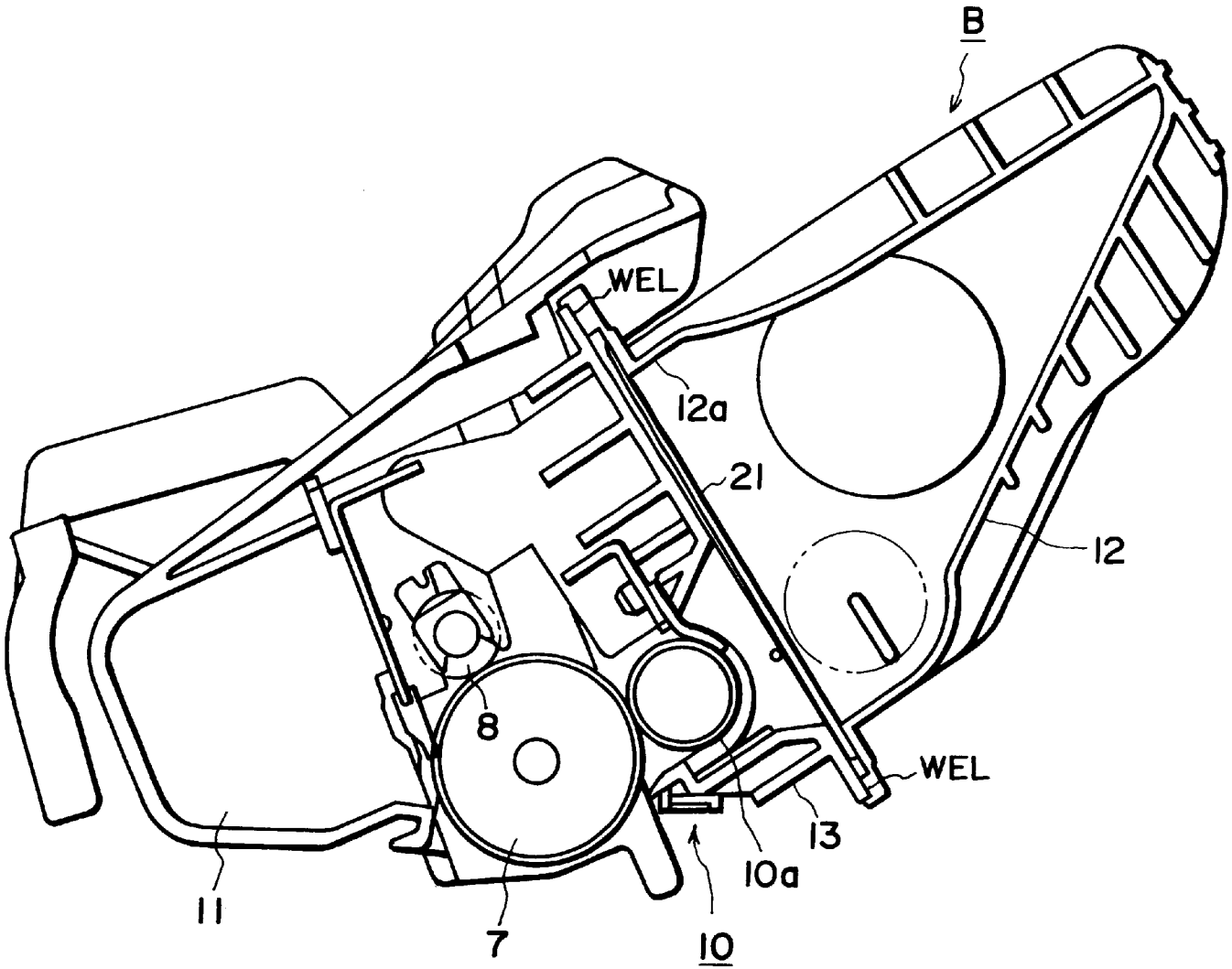
FIG. 2 is a vertical cross section of a process cartridge in accordance with the present invention.

Referring to FIGS. 1 and 2, an electrophotographic image forming apparatus, such as an electrophotographic copying machine, an electrostatic recording apparatus, or a laser beam printer, to which the present invention can be applied, and also a process cartridge which is mounted into the electrophotographic image forming apparatus, will be described. FIG. 1 is a drawing which illustrates the general structure of the main assembly of an image forming apparatus, into which a process cartridge has been mounted. FIG. 2 is a vertical section of the essential portion of the process cartridge, at the plane which runs perpendicular to the longitudinal direction of the process cartridge.

<General Structures of Image Forming Apparatus and Process Cartridge>

The image forming apparatus A illustrated in FIG. 1 is structured so that, as a cover 16 is opened, and a process cartridge is mounted into the main assembly of the image forming apparatus A, and the electrodes 24*e* and 24*f* on the process cartridge side make contact with the electrodes 24*ee* and 24*ff*, respectively, on the main apparatus side of the image forming apparatus A. The image forming apparatus A also comprises an optical means 1, a manual feeding tray 3, an automatic sheet feeder roller 17, a transfer roller 4, a fixing means 5, a delivery tray 6, and a sheet discharge roller 15. The optical means 1 is positioned so that it will be above the process cartridge B after the mounting of the process cartridge B. The manual and automatic sheet feeder trays 3 and 7 are positioned to the right- and left-hand, respectively, of the cartridge space, and the transfer roller 4 is positioned below the process cartridge space. The fixing means 5 is positioned to the left of the transfer roller 4, and the delivery tray 6 and the sheet discharge roller 15 are positioned above the fixing means 5.

The image forming apparatus A in this first embodiment of the present invention, which is illustrated in FIG. 1, can also be fed with sheets of recording medium, with the use of a sheet cassette 9, which is positioned at the bottom of the image forming apparatus A main assembly as illustrated in FIG. 1.

Next, referring to FIG. 2, the process cartridge B comprises a photosensitive drum 7 as an image bearing member which is rotatively driven, a charge roller 8 disposed immediately adjacent to the peripheral surface of the photosensitive drum 7, a developing means 10 which comprises a development sleeve 10*a* as a developer bearer, a cleaning apparatus 11, and the like, which are integrally assembled as a unit in the cartridge frame.

Next, the operation of the image forming apparatus A will be briefly described with reference to FIGS. 1 and 2.

In an image forming operation, the peripheral surface of the photosensitive drum 7 in the process cartridge B is uniformly charged by the charge roller 8, and a laser beam modulated with the image formation data from an original is projected from the optical means 1, upon the uniformly charged peripheral surface of the photosensitive drum 7, forming an electrostatic latent image on the peripheral surface of the photosensitive drum 7. The electrostatic latent image on the photosensitive drum 7 is developed into a toner image, that is, a visible image, with the use of toner, as developer, borne on the development sleeve 10*a* of the developing apparatus 10.

As described before, pieces of recording medium 2, such as transfer sheet, can be fed, one-by-one into the main assembly of an image forming apparatus from either the manual feeder tray 3, or the cassette 9, by a feeder roller 17 or 18, respectively. The fed recording medium 2 passes between the peripheral surfaces of the photosensitive drum 7 and the transfer roller 4. While the recording medium 2 is passing between the photosensitive drum 7 and the transfer roller 4, the toner image on the photosensitive drum 7 is transferred onto the recording medium 2.

After the transfer of the toner image onto the recording medium 2, the recording medium 2 is conveyed to the fixing means 5, in which the toner image is fixed to the recording medium 2 by heat and pressure. Thereafter, the recording medium 2 is discharged out of the image forming apparatus A into the delivery tray 6, being accumulated therein, by a discharge roller 15.

The process cartridge B is constituted of a toner chamber frame 12 and a developing means frame 13, which are welded together along their top and bottom longitudinal edges by ultrasonic welding. The toner chamber frame 12 constitutes a developer container, and its opening 12*a* is sealed with a toner seal 21 after the developer container is filled with toner. The developing means frame 13 supports developing members, such as the development sleeve 10*a*. The longitudinal ends of the process cartridge B, in terms of the axial direction of the photosensitive drum 7, are sealed with an elastic seal. One of the elastic seals presses a tear tape 21*b* upon the toner chamber frame 12, at a slit 22 through which the toner seal is pulled out of the process cartridge B.

<Structure of Toner Seal>

Next, referring to FIGS. 3, 4, 5 and 6, the structure of the toner seal will be described.

Figure 3:
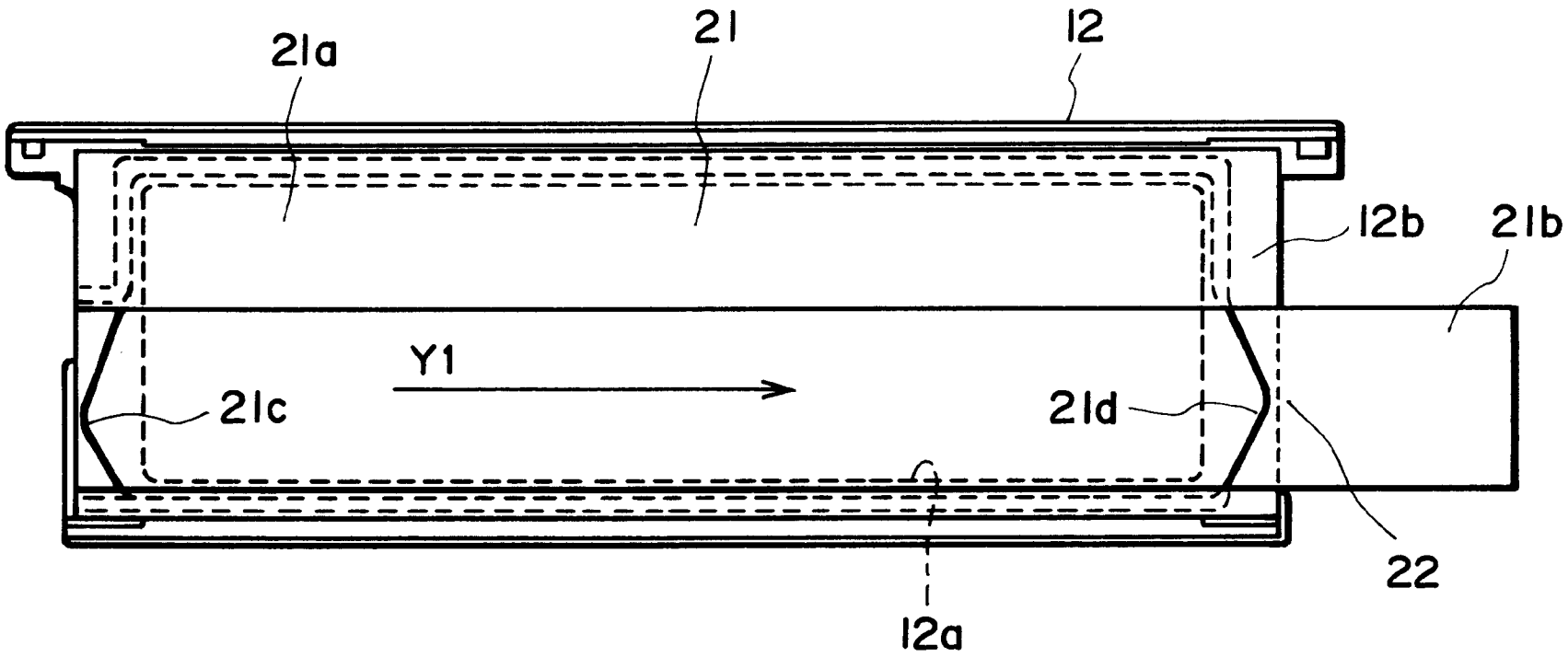
FIG. 3 is a front phantom view of a toner container, and depicts the toner container structure, and the toner seal.
Figure 4:
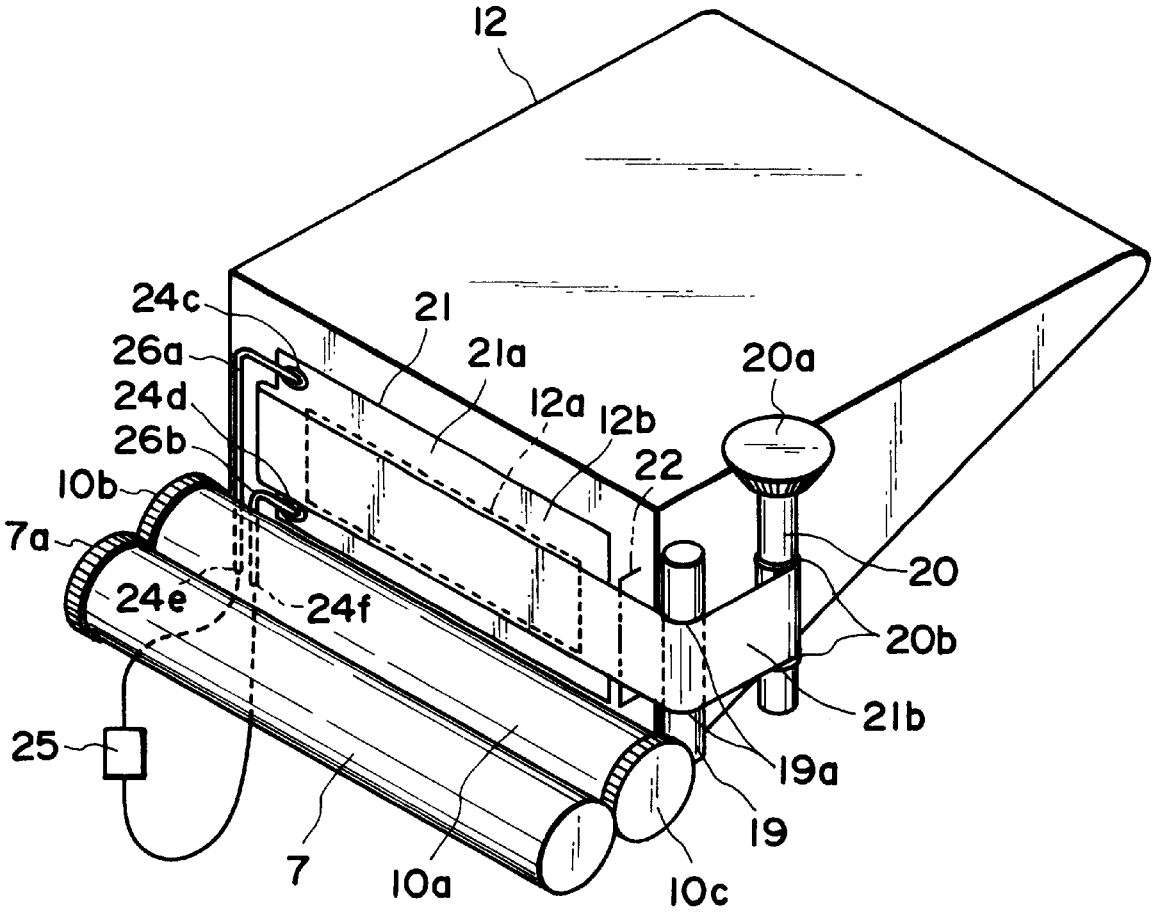
FIG. 4 is a perspective view of the developing apparatus in the first embodiment of the present invention.
Figure 5:
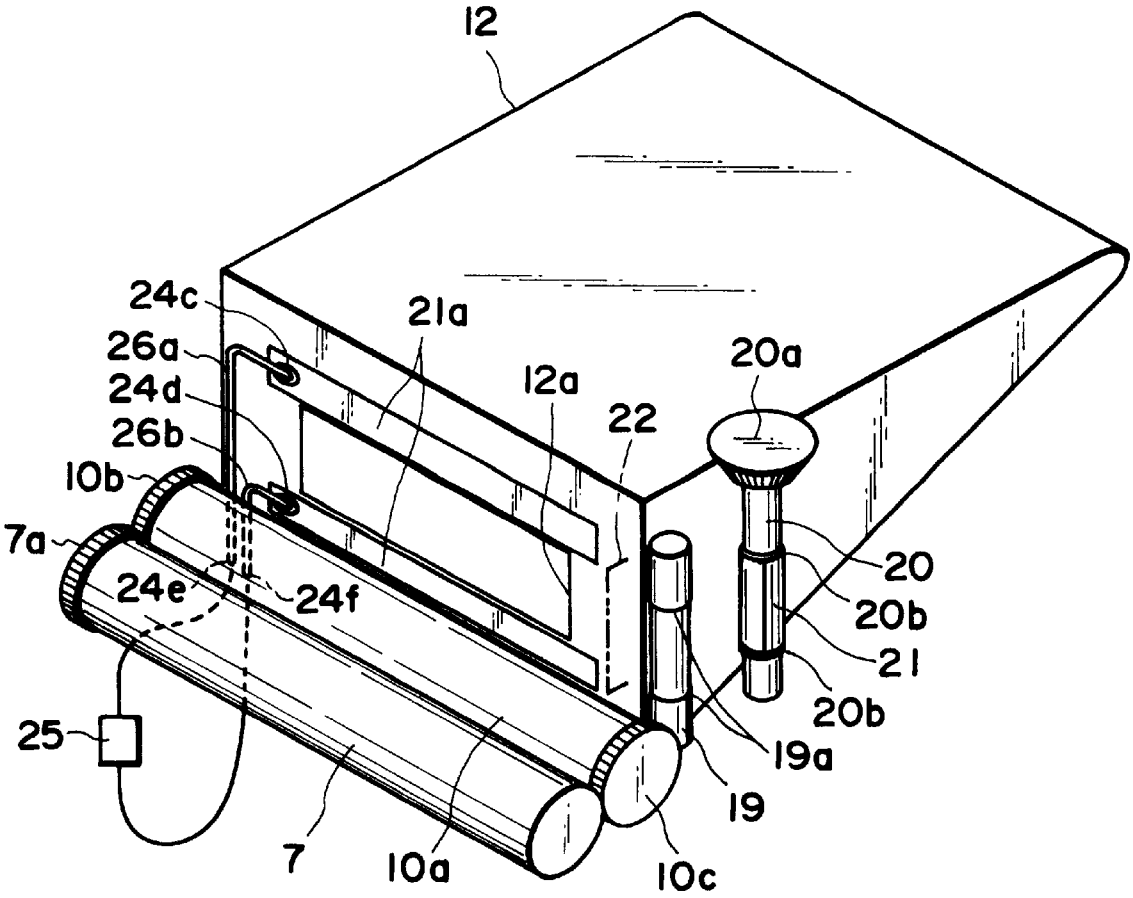
FIG. 5 is a perspective view of the developing apparatus in the first embodiment of the present invention.
Figure 6:
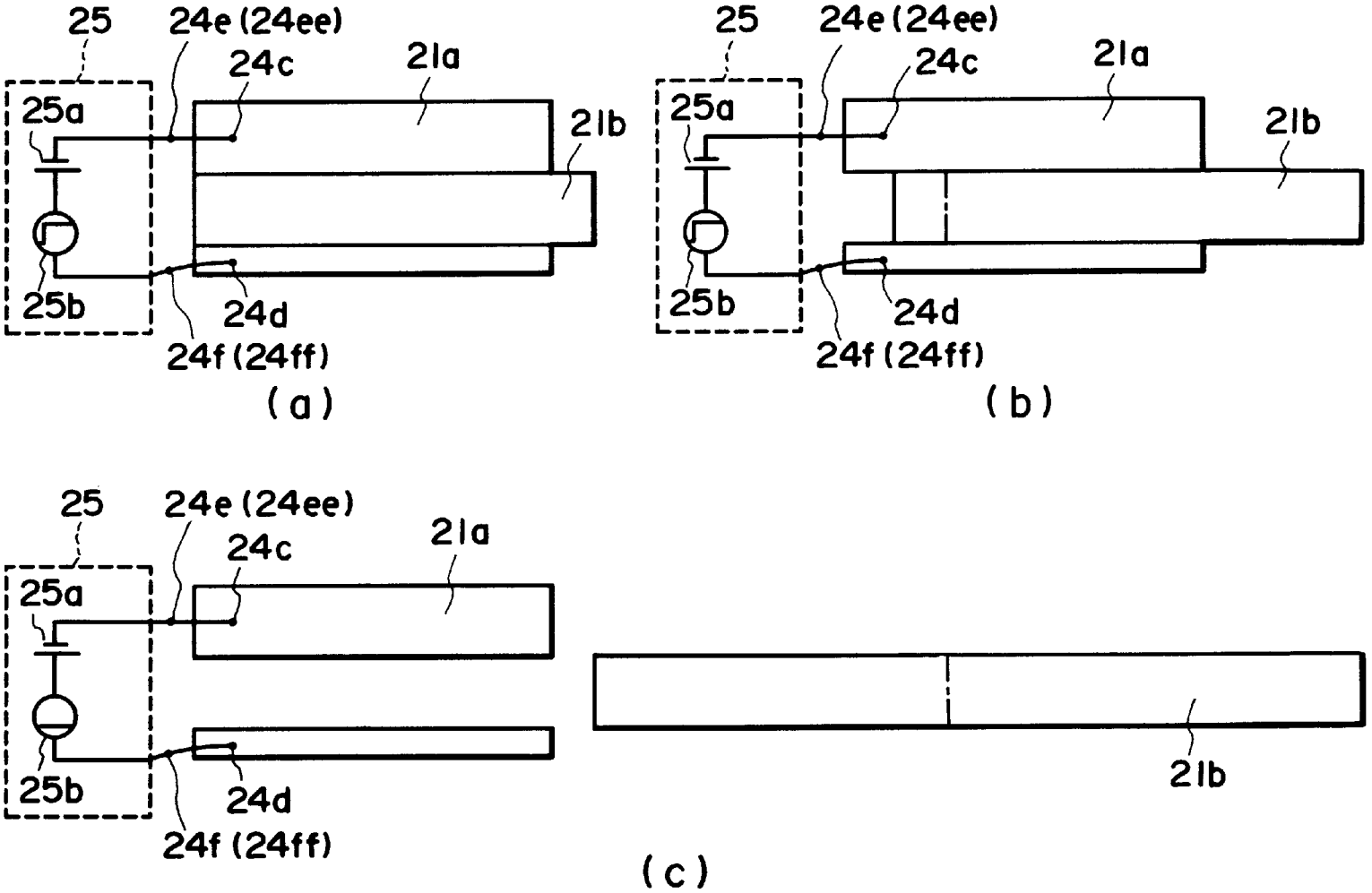
FIGS. 6, (*a*), (*b*) and (*c*) are circuit diagrams for the toner seal detecting means in the first embodiment of the present invention.

FIGS. 4 and 5 are perspective views of the developer chamber frame 12, the developing apparatus 10, and their adjacent elements. FIGS. 3 and 6 are plans of the developer chamber frame 12, as seen from its opening 12*a* side.

FIGS. 3 and 4 are drawings which illustrate the toner chamber frame 12, with its opening 12*a* sealed with the toner seal 21. The toner seal consists of a cover film 21*a*, that is, the portion of the toner seal 21 which actually covers the opening 12*a*, and a tear tape 21*b*, that is, the portion which has a length of no less than twice the length of the cover film 21*a* in terms of the longitudinal measurement of the cover film 21*a*, and is used to tear away the cover film 21*a*. The cover film 21*a* is fixed to the periphery 12*b* of the opening 12*a*. Referring to FIG. 3, the tear tape laminated to the cover film 21*a* is thermally adhered, together with the cover film 21*a*, to the toner chamber frame 12, by the so-called boat-shaped portions 21*c* and 21*d*, at both longitudinal ends of the toner chamber frame 12. The tear tape 21*b* is folded back at the deep end in terms of the direction indicated by an arrow mark Y in which the toner seal 21 is pulled away, and is caused to project outward from the slit 22.

<Means for Reeling Toner Seal>

Next, referring to FIGS. 4 and 5, the means for reeling the toner seal will be described. FIG. 4 is a drawing which depicts the structure of the means for reeling the toner seal, and FIG. 5 is a drawing which illustrates the toner seal 21 which has been removed, or reeled away. As the process cartridge B is mounted into the image forming apparatus A, the end of the tear tape 21*b*, which is projecting from the toner seal slit 22 of the process cartridge B, is guided to a reeling shaft 20 rotatively supported by the toner chamber frame 12, by an idler roller 19 rotatively supported by the toner chamber frame 12, and then is fixed to the reeling shaft 20 with adhesive or the like. Next, the means for transmitting driving force to the reeling shaft 20 will be described. After the process cartridge B is mounted into the image forming apparatus A, a driving force is transmitted to the process cartridge B, and more specifically, to the drum gear 7*a* fixed to one of the longitudinal ends of the photosensitive drum 7 in the process cartridge B. from an unillustrated driving power source on the image forming apparatus A side. The development sleeve 10*a* is provided with development sleeve gears 10*b* and 10*c*, which are fixed to one of the longitudinal ends of the development sleeve 10*a*, and the other, respectively. The development gear 10*c* is meshed with the aforementioned drum gear 7*a*, and the development sleeve gear 10*b* is meshed with an unillustrated idler gear. As the driving force is transmitted from the image forming apparatus A side to the drum gear 7*a*, the development sleeve gear 10*b* meshed with the drum gear 7*a* is driven, which in turn drives the development sleeve gear 10*c* along with the development sleeve gear 10*b*. Thus, the development sleeve gear 10*c* drives the bevel gear 20*a* through the unillustrated idler gear. As a result, the driving force is transmitted to the reeling shaft 20 coaxial with the bevel gear 20*a*, rotating the reeling shaft 20. As the driving force rotates the reeling shaft 20, the toner seal 21 is wound around the peripheral surface of the reeling shaft while being guided by the guiding portion 19*a* of the aforementioned idler roller 19. The reeling shaft is provided with guides 20*b*, so that the toner seal 21 is prevented from being wound around the peripheral surface of the reeling shaft 20, on the portion other than the designated portion. Consequently, the cover film 21*a* is torn away from the toner chamber frame 12, from the deeper end, in terms of the direction in which the toner seal 21 is pulled, exposing the opening 12*a*.

FIG. 4 is a perspective view of the toner chamber frame 12 of the process cartridge B in this embodiment, in which the opening 12*a* of the toner chamber frame 12 is sealed with the toner seal 21, and the developing means frame 13 is not shown. As for the material for the toner seal 21, usage of laminated sheet composed of aluminum film and polyethyleneterephthalate (PET) film has been proposed. Also in this embodiment, this laminated sheet composed of the layers of aluminum film and PET film is employed. In order to make it easier to tear the toner seal 21, the toner seal 21 is provided with a guiding means (for example, the provision of a shallow cut in the surface of the toner seal 21). Further, the toner seal 21 is provided with electrical contact points 24*c* and 24*d*, which are positioned on the area which is not reeled away by the reeling shaft 20, and remains on the toner chamber frame 12 side after the major portion of the toner seal 21 is reeled away by the reeling shaft 20 to expose the opening 12*a*. These contacts 24*c* and 24*d* will be described later.

Referring to FIG. 5, as the toner seal 21 is reeled away, two portions (electrical contact point 24*c* side and electrical contact point 24*d* side) of the toner seal 21 remain adhered to the toner chamber frame 12, on the opposite sides across the opening 12*a*. The electrical contact points 24*c* and 24*d* are positioned on the toner seal 21, on the separate portions, one for one, which remain adhered to the toner chamber frame 12, on the opposite sides of the opening 12*a* in terms of the width direction of the opening 12*a*, even after the removal of the major portion of the toner seal 21, so that the electrical connection between the two electrical contact points 24*c* and 24*d* is broken as the cover film 21*a* of the toner seal 21 is torn away.

Next, the structures of the electrical contact points 24*c* and 24*d* will be described.

The PET film has been removed from the two portions of the cover film 21*a*, to which the aforementioned electrical contact points 24*c* and 24*d* are to be attached, respectively, to expose the aluminum film. With the two electrical contact points 24*c* and 24*d*, elastic steel plate electrodes 26*a* and 26*b*, respectively, are placed in contact, pressing down upon the electrical contact points 24*c* and 24*d*, and consequently, pressing indirectly upon the toner seal 21. This arrangement establishes an electrical connection between the elastic steel plate electrodes 26*a* and 26*b* through the electrical contact point 24*c*, the aluminum film, and the electrical contact point 24*d*. The other ends of the elastic steel plate electrodes 26*a* and 26*b* are routed out of the toner chamber frame 12, and constitute electrical contact points 24*e* and 24*f*, with which the detecting means on the image forming apparatus main assembly side is electrically connected. The elastic steel electrodes 26*a* and 26*b* are fixed to the toner chamber frame 12, and are sealed with unillustrated seals formed of, for example, Moltplane, to prevent the toner from leaking out of the toner chamber frame 12.

Again referring to FIG. 1, the main assembly side of the image forming apparatus is provided with electrical contact points 24*ee* and 24*ff*, so that an electrical connection is established between the aforementioned electrical contact points 24*c* and 24*d* and the main assembly side as the process cartridge is mounted into the main assembly.

FIGS. 6, (*a*), (*b*) and (*c*) are schematic drawings of the toner seal, and the electrical contact points 24*c* and 24*d* inclusive of their electrical connection. FIG. 6(*a*) depicts their states prior to, or at the time when, the reeling of the toner seal 21 begins, and FIG. 6(*b*) depicts their states while the toner seal 21 is being reeled away. FIG. 6(*c*) depicts their states after the completion of the reeling of the toner seal 21. Referring to FIG. 6(*a*), prior to the starting of the toner seal reeling, the electrical contact points 24*c* and 24*d* are electrically connected through the electrically conductive aluminum film layer of the laminated toner seal 21. Next, referring to FIG. 6(*c*), after the completion of the toner seal reeling, there is no electrical connection between the electrical contact points 24*c* and 24*d*, which are on the top and bottom portions, in terms of their position in the drawing, of the toner seal, which remain on the toner chamber frame 12. In other words, whether or not the toner seal 21 has been removed can be detected by positioning a detecting means 25 between the electrical contact points 24*c* and 24*d* in terms of electrical circuitry. This will be described next.

Referring to FIG. 6, the difference in electrical potential is provided between the aforementioned electrical contact points 24*c* and 24*d* with the use of direct current power source 25*a*, and whether or not the toner seal 21 of the process cartridge B has been completely reeled is detected by measuring the amount of current which flows between the electrical contact points 24*c* and 24*d*, with the use of a monitor 25*b*. In other words, it is possible to determine whether a process cartridge is brand new, that is, has never been used, or it has been unsealed and in use, by detecting whether or not the toner seal 21 is present. The detecting means 25, inclusive of the direct current power source 25*a* and the monitor 25*b*, is provided on the main assembly side of the image forming apparatus, and signalizes the result of the detection as to whether or not the toner seal 21 of the process cartridge B has been completely reeled. The signalized information is used to determine the length of the remaining service life of the process cartridge B as will be described below.

In the case of the image forming apparatus A in this first embodiment, the cumulative data of the process cartridge B, for example, the cumulative number of rotations of the photosensitive drum 7 of the process cartridge B, the cumulative number of the pieces of recording medium 2 passed through the apparatus A, the print ratio, and the like, are stored on the image forming apparatus A side. Further, the image forming apparatus A main assembly is provided with a means (unillustrated) for displaying the length of the remaining service life and current state of the process cartridge B, to an operator. The means for detecting the length of the remaining service life of the process cartridge B counts the cumulative number of developed picture elements, calculates the cumulative amount of the consumed toner based on the cumulative number of the developed picture elements, and then, determines the length of the remaining service life of the process cartridge based on the cumulative amount of the consumed toner.

When it is determined by the aforementioned toner seal detecting structure that the toner seal 21 in the process cartridge B which has just been mounted in the image forming apparatus main assembly had been completely reeled, in other words, the mounted process cartridge B had been in use, the process cartridge B usage data, which had been accumulated on the image forming apparatus main assembly side, are treated as the data regarding the process cartridge B which has just been mounted into the image forming apparatus A, and the data obtained from this just mounted process cartridge B are cumulatively added to the process cartridge data which had been accumulated. However, when it is determined that the toner seal 21 of a process cartridge B which has just been mounted had not been reeled, in other words, the mounted process cartridge B is brand new, the storage which had been storing the process cartridge usage data is reset, and begins to store the fresh data.

With the above arrangement, whether a process cartridge B, which has just been mounted into the image forming apparatus main assembly, is such a process cartridge that was temporarily removed to take care of a paper jam, and has been remounted, or such a cartridge that has been mounted in place of a process cartridge B with an expired service life, can be clearly determined by detecting whether or not the toner seal 21 is present. Therefore, a user can accurately know the length of the remaining service life of the mounted process cartridge, and therefore, can accurately grasp when the process cartridge B should be replaced.

In the above embodiment, the reeling shaft 20 is indirectly driven through an unillustrated gear train, and the structural components of the process cartridge (in the above embodiment, the development sleeve 10*a* is provided with the gear 10*c*), by an unillustrated driving power source on the image forming apparatus main assembly side. However, the reeling shaft 20 may be disposed within the process cartridge B, and directly connected to a driving power source within or outside the process cartridge B.

Further, the toner seal in the above embodiment was of a type with a tear tape. However, the toner seal may be of a type with no tear tape, that is, an easy-peel type which is entirely peeled off from the toner container. It is obvious that the present invention is also applicable to the toner seal of an easy-peel type.

(Embodiment 2)

In Embodiment 1, the electroconductive portion for unsealing detection of the seal portion is provided on the whole surface of the seal portion, but in this embodiment, it is provided in a part thereof.

Figure 7:
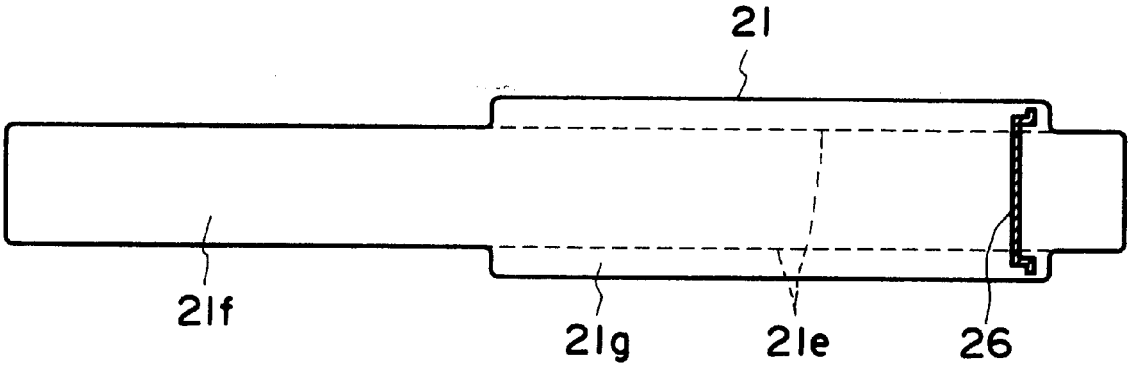
FIG. 7 is a plan view of the toner seal in the second embodiment of the present invention, and depicts the toner seal structure.
Figure 8:
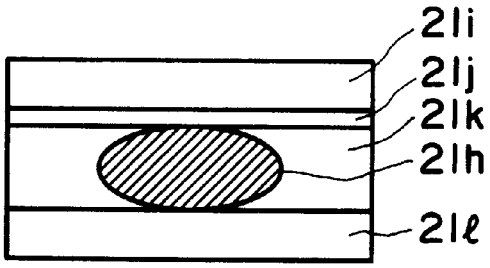
FIG. 8 is a vertical section of the toner seal in the second embodiment of the present invention, and depicts the toner seal structure.

FIGS. 7, 8 show a developer seal 21 as a seal member for sealing the opening of the developer accommodating container 12

The layer structure of the seal base in this example are, from the surface layer side:

Polyester 12 μm (strength maintaining layer, 21*i* in FIG. 8);

Aluminum foil 7 μm (laser blocking layer, 21*j* of FIG. 8);

Polyester 50 μm (tear guide layer, 21*k* of FIG. 8);

Sealant layer 50 μm (container bonding layer, 21*l* of FIG. 8).

A tearing portion 21*e* for unsealing is subjected to a carbon dioxide gas laser from the sealant layer side, so that the polyester layer (tearing guide layer) and the sealant layer partly melts to form a void portion or a cavity by a laser cutting process. (FIG. 8 is a sectional view of the seal member, and shows the gap 21*h* provided by the laser machining). The aluminum foil layer blocks the laser, so that a sufficient sealing property is assured without damage to the outermost surface polyester layer.

Upon the unsealing, the stress is concentrated at the gap formed by the laser machining process, and therefore, it can be assuredly torn and unsealed along the tearing portion 21*e*.

As shown in FIG. 7, an electroconductive portion 26 for unsealing detection is provided at an end of the developer discharging opening of the developer accommodating container (immediately before the ending portion of the unsealing).

In this example, the electroconductive portion 26 is composed of aluminum foil with adhesive material (aluminum foil 30 μm and adhesive material 50 μm), and is pasted on the surface of the seal base.

Figure 9:
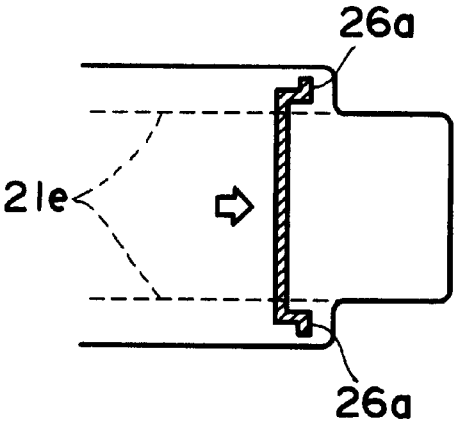
FIG. 9 is an enlarged plan view of the electrically conductive portion of the toner seal in the second embodiment of the present invention.

The electroconductive portion 26, as shown in FIG. 9, is extended in a width direction which is perpendicular to the unsealing direction (direction indicated by the arrow in FIG. 9 (enlarged view)) of the developer seal, and has contact portions 26*a* at the end thereof. The contact portions 26*a* are disposed outside the tearing portion 21*e* which is removed upon the unsealing of the developer seal, and therefore, are not removed but remains on the accommodating container after completion of the unsealing. The contact portions 26*a* are contacted to contacts (unshown) of a developing device, developer hopper or the like which receives the developer accommodating container, by which the electrical connection is established as shown in FIG. 1.

The width of the electroconductive portion 26 is 2 mm, and the length in the lateral direction is approximately 50 mm.

Figure 20:
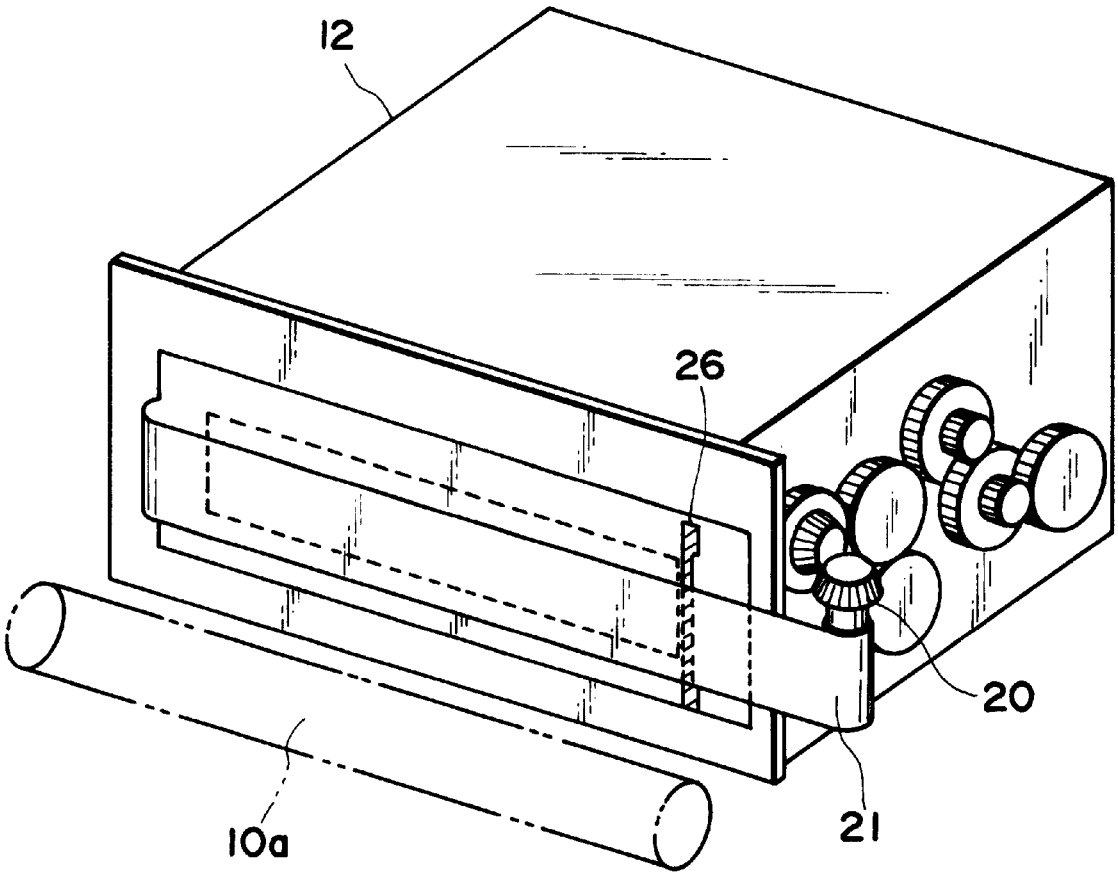
FIG. 20 is a perspective view of the developer container, the toner seal, and adjacent elements, in the second embodiment of the present invention, in which the toner seal has been fixed to the developer container.

FIG. 20 shows the assembled state of the developer accommodating container with the developer seal of this example.

Figure 10:
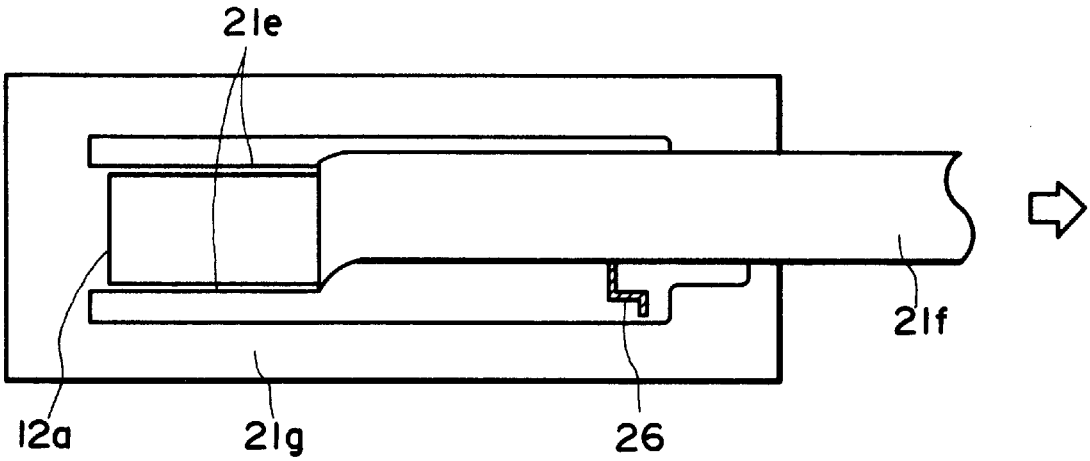
FIG. 10 is a plan view of the toner seal in the second embodiment of the present invention, which has been partially separated from the toner container.
Figure 11:
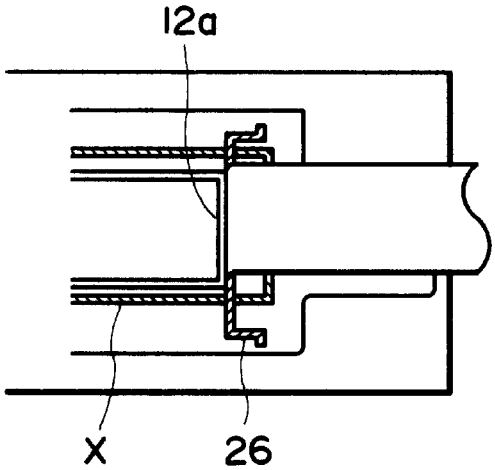
FIG. 11 is an enlarged plan view of the electrically conductive portion of the toner seal in the second embodiment of the present invention, and depicts the state of the toner seal which has been almost completely separated from the toner container.
Figure 12:
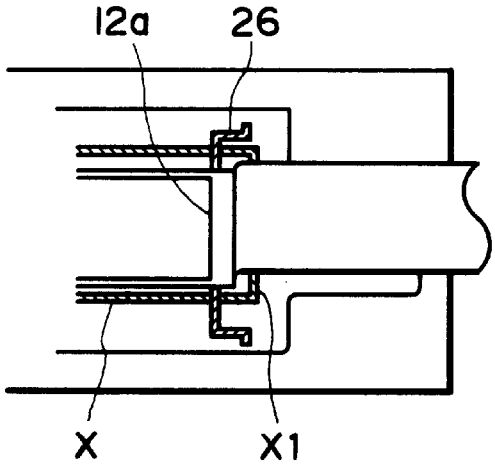
FIG. 12 is an enlarged plan view of the electrically conductive portion of the toner seal in the second embodiment of the present invention, and depicts the state of the toner seal at the end of its removal.

FIGS. 10, 11 and 12 show the unsealing operation of the developer seal of this example.

FIG. 10 shows the state during unsealing.

In the unsealing of the developer seal 21, a force receiving portion 21*f* is pulled in the fold-back direction (direction indicated by the arrow in FIG. 10), so that sealing portion 21*g* is torn along the unsealing tearing portion 21*e* with the width substantially the same as the width of the developer discharging opening. FIG. 11 shows, in an enlarged scale, a state wherein the electroconductive portion 26 at the end portion of the developer discharging opening is being torn, and FIG. 12 shows, in an enlarged scale, the state after the sealing. When the electroconductive portion 26 is torn with the developer seal, the conduction is stopped, so that the main assembly of the image forming apparatus can detect the unsealing state of the developer seal.

Figure 21:
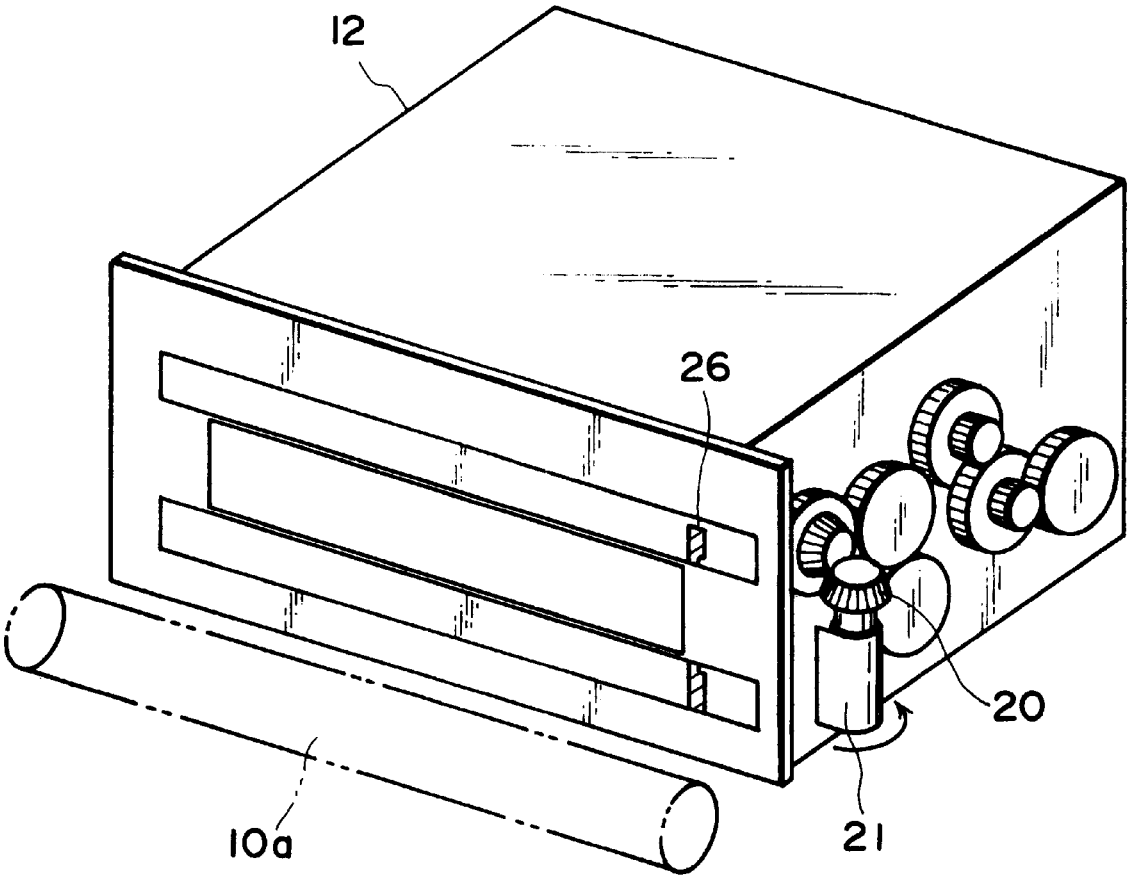
FIG. 21 is a perspective view of the developer container, the toner seal, and adjacent elements, in the second embodiment of the present invention, in which the toner seal has been removed (complete removal).
Figure 22:
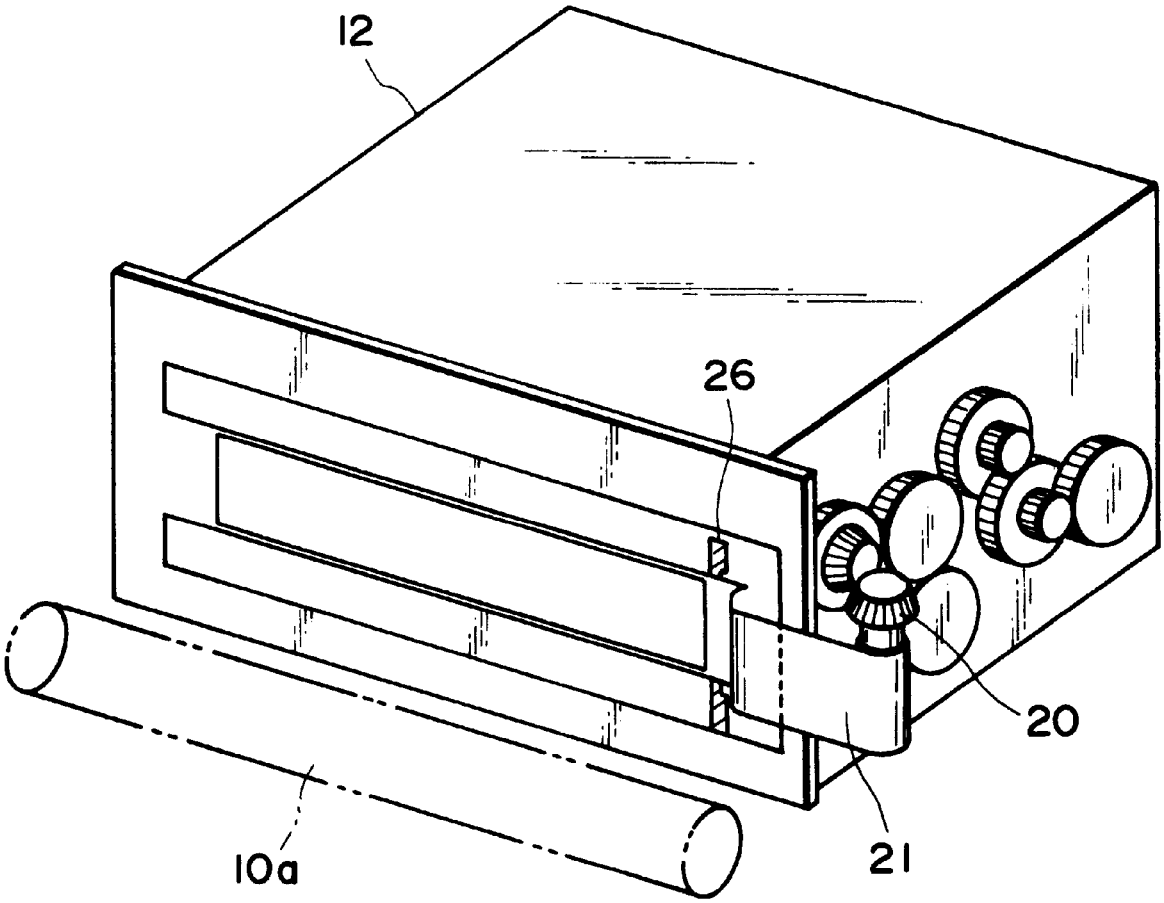
FIG. 22 is a perspective view of the developer container, the toner seal, and adjacent elements, in the second embodiment of the present invention, in which the toner seal has been almost completely removed, with the end portion still remaining on the toner chamber frame.

In this example, the seal member may be wound up or may not be wound up, and as shown in FIG. 21, upon the completion of the unsealing, the seal member may be completely removed, or as shown in FIG. 22, pulling of the seal may be stopped after detecting the unsealing, so that the end portion of the seal member may remain, depending on the structure of the main assembly of the image forming apparatus using the developer accommodating container of this example. As shown in FIG. 22, in the case that after the detection of the unsealing, the pulling of the seal is stopped to leave the end of the seal member, the pulling of the seal can be stopped before an end portion X1 of a heat welded portion X of the seal member relative to the developer accommodating container is removed. In this case, it is not necessary to remove the end portion of the heat welded portion, and therefore, the required unsealing force is smaller than when the seal member is completely torn and removed.

The electroconductive portion 26 of this example uses a pasted aluminum foil. The electric resistance value thereof will be considered. As regards the electric resistance value of the electroconductive portion for the detection of conduction, if the voltage applied across it by the voltage source 25*a* of the main assembly of the image forming apparatus can be high, the resistance value may be large. However, the high voltage is not desirable from the viewpoints of safety and cost, and therefore, the electric resistance value is preferably small to permit use of a low voltage, and more particularly, not more than 100 Ω, and preferably 10 Ω. The electroconductive portion 26 of this example has an electric resistance value of 1 Ω, and sufficient conduction is provided before cutting. After the cut, the electric resistance is infinite, i.e. non-conductive.

Therefore, the low electric resistance value capable assuring sufficient conduction before the cut, is preferable, and any material satisfying this, such as copper, nickel or other metal foil, is usable.

The aluminum foil is normally enough to provide sufficient conductivity, but due to the oxidation of the surface of the foil, the electric resistance value may become too high. In view of this, the surface may preferably be provided with anti-oxidation layer such as carbon and nickel, so as to assure the unsealing detection.

The electroconductive portion 26 has to be torn along the tearing portion 21*e* of the developer seal. If it is not torn with small force and with a certainty, the unsealing force is so high that the entirety of the foil is pulled out, and is stuck on the other part or it falls.

Therefore, to decrease the rupture strength, the material, the width, the thickness and the like of the electroconductive portion are preferably taken into account, with the fact that the width or the thickness are decreased, and the electric resistance value tends to increase.

The aluminum foil of this example has a width of 2 mm, a thickness of 30 μm and an electric resistance value of 1 Ω, with which the force required for tearing it is 0.1–0.2 kgf, which is sufficiently small.

The electroconductive portion 26 of this example is pasted on the surface of the developer seal before welding of the developer seal onto the developer accommodating container or after that, but when it is pasted before the welding, the electroconductive member preferably has a heat-resistivity. When it is pasted after the welding, care should be taken on the pasting position, and the member, including the contact portion, is preferably simplified. In this example, it is pasted after the welding. No problem with the pasting was confirmed since the electroconductive member has a channel-like cross-section. More simple structure is usable. As regards the fixing method relative to the developer seal, the adhesive material is used in this example, but double coated tape, another bonding or welding method is usable.

Unsealing confirmation tests have been carried out for the developer accommodating container using the developer sealing member, it has been confirmed that the unsealing strength of the electroconductive portion is as small as 0.2–0.3 kgf including the developer seal per se, and the unsealing was good with assured detection of unsealing.

(Embodiment 3)

In this example, the electroconductive portion on the surface of the seal base of the developer seal includes the unsealing detection electroconductive portion of Embodiment 2 and a mounting detection electroconductive portion for detecting mounting of the developer accommodating container at the correct position. The developer seal structure, the material of the electroconductive portions, and the bond onto the surface of the seal base or the like, are the same as with Embodiment 2.

Figure 13:
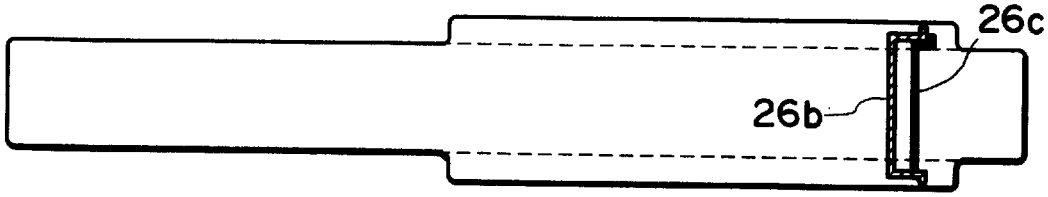
FIG. 13 is a plan view of the toner seal in the third embodiment of the present invention, and depicts the structure thereof.
Figure 14:
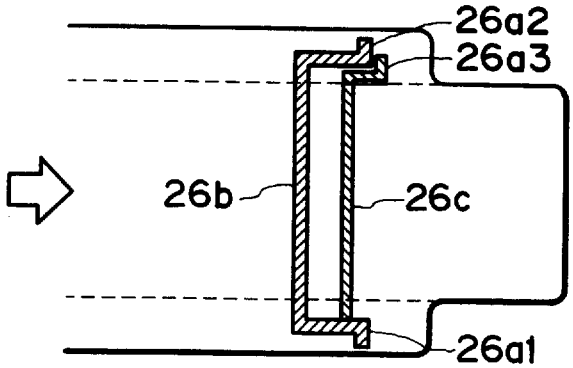
FIG. 14 is an enlarged plan view of the electrically conductive portion of the toner seal in the third embodiment of the present invention.

The developer seal of this example is shown in FIG. 13. In the electroconductive portion 26 of FIG. 13, the inside one 26*b* is the unsealing detection electroconductive portion, and the outside one 26*c* is the mounting detection electroconductive portion. FIG. 14 is an enlarged view of the electroconductive portion. Therefore, the upstream is for unsealing detection 26*b*, and the downstream is for mounting detection 26*c* with respect to the unsealing direction (direction indicated by the arrow in FIG. 14).

In this example, the two electroconductive portions for the unsealing detection and the mounting detection, are extended in the lateral direction perpendicular to the unsealing direction, similar to Embodiment 2. As regards the contact portions 26*a*, one 26*a*1 is common, and at the other side, it is separated into portions 26*a*2 and 26*a*3. The contacts 26*a*1 may be provided separately, the number of contacts is increased with the possible result of cost rise or poor assembling property. A common contact for 26*a*2, 26*a*3, is not usable, since then the use of two lines is meaningless.

Figure 15:
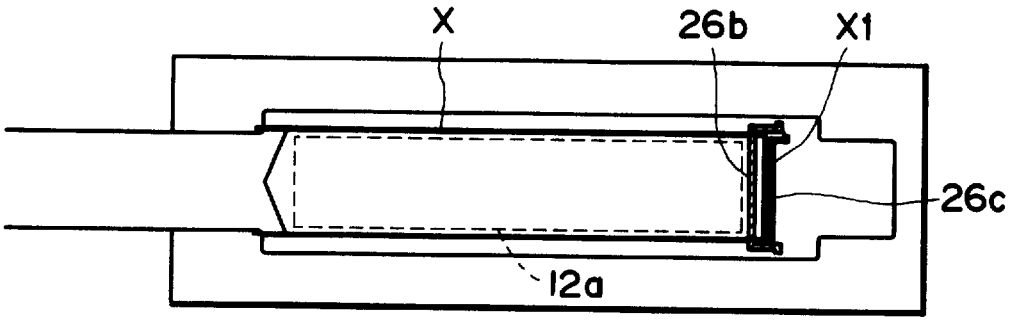
FIG. 15 is a plan view of the toner seal in the third embodiment of the present invention, which has been thermally welded to the developer container.
Figure 23:
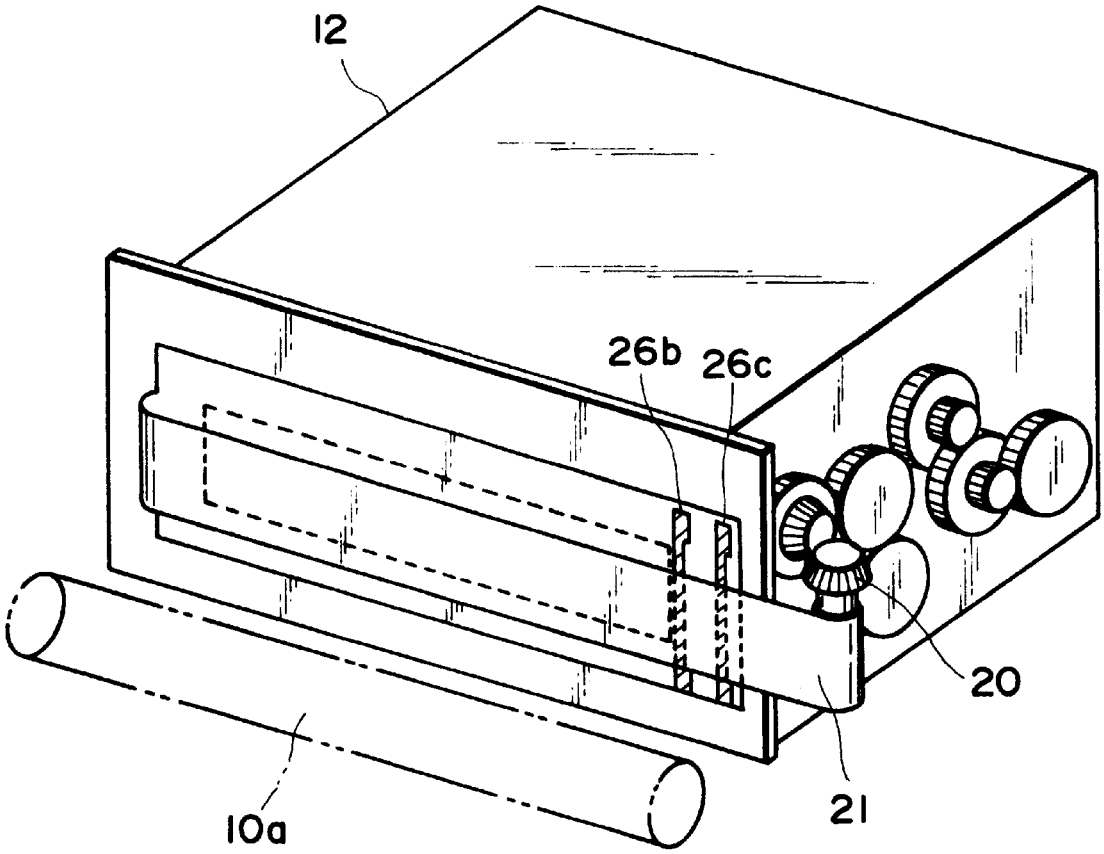
FIG. 23 is a perspective view of the developer container, the toner seal, and adjacent elements, in the third embodiment of the present invention, in which the toner seal has been fixed to the developer container.

The state in which the developer seal of this example is welded on the developer accommodating container is shown in FIG. 15, and an assembled state is shown in FIG. 23.

Figure 24:
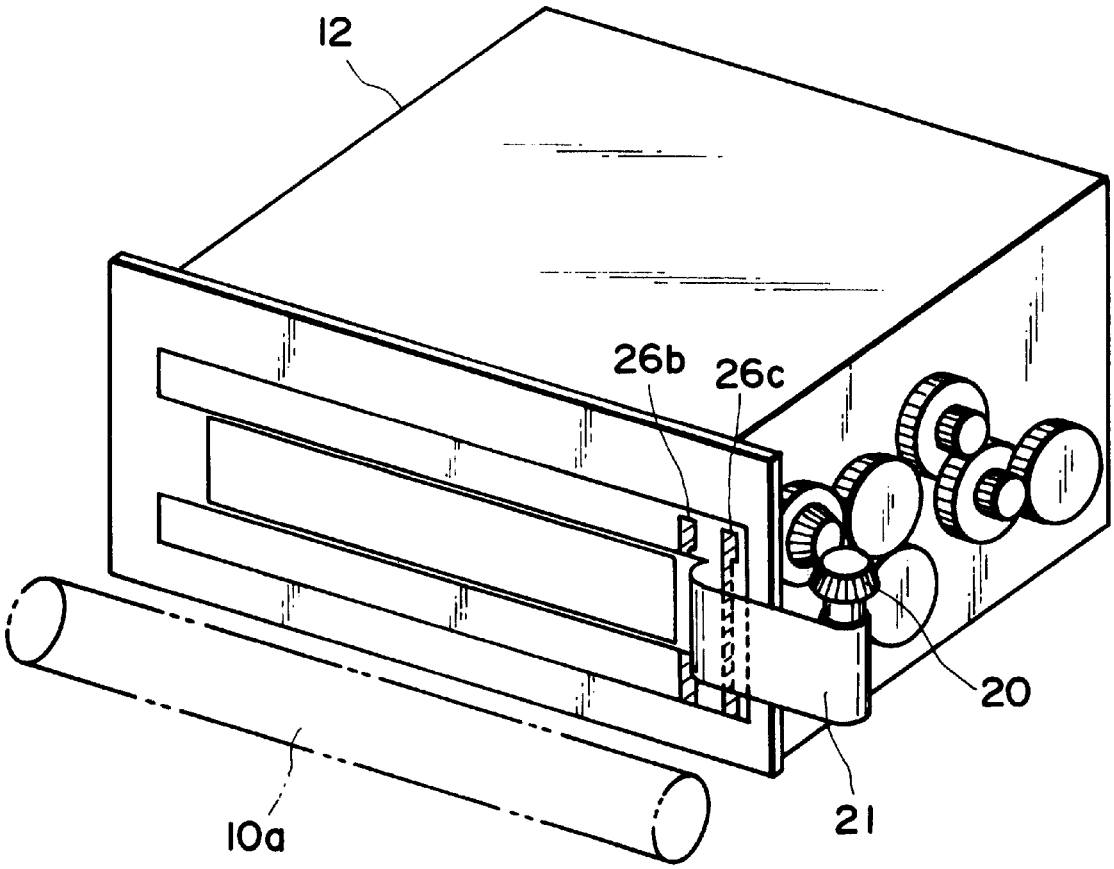
FIG. 24 is a perspective view of the developer container in the third embodiment of the present invention, in which the toner seal has been almost completely removed.

The unsealing detection electroconductive portion 26*b* is disposed at an end portion of the developer discharging opening, and the mounting detection electroconductive portion 26*c* is disposed further outside (downstream). Similar to Embodiment 2, with the opening of the developer seal, the unsealing detection electroconductive portion is torn substantially simultaneously with full opening of the developer discharging opening, the conduction of the unsealing detection electroconductive portion (26*a*1–26*a*2) is broken, so that the unsealing state is detected, and at this time, the unsealing operation of the seal is stopped. The unsealing operation of the seal may be manual or automatic, and the seal may be wound up or may not be wound up. However, the automatic winding is preferably used, and the winding shaft drive is stopped immediately after the unsealing detection, and the unsealing operation is stopped before the mounting detection electroconductive portion. This is preferable. FIG. 24 shows the state upon completion of the developer seal winding.

Figure 16:
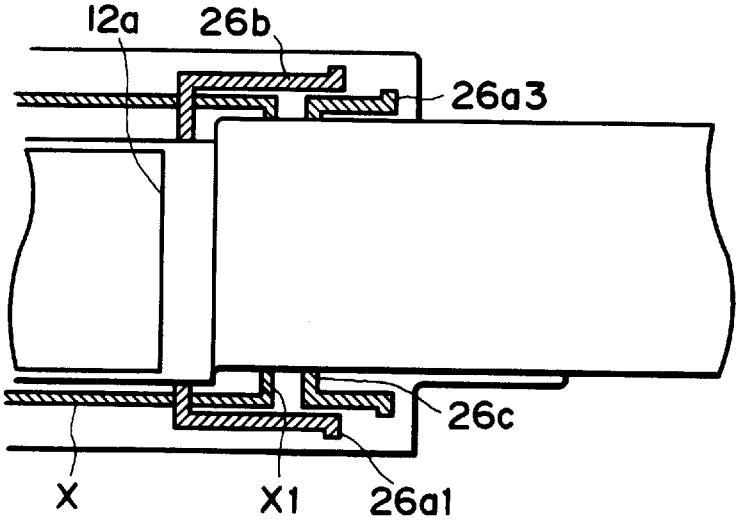
FIG. 16 is an enlarged plan view of the electrically conductive portion of the toner seal portion, at the end of the toner seal removal.

FIG. 16 is an enlarged view of the electroconductive portion when the developer seal has been unsealed. The unsealing detection electroconductive portion 26*b* is cut, but the mounting detection electroconductive portion 26*c* is maintained in the same state, so that conduction thereof (26*a*1–26*a*3) is kept.

Figure 25:
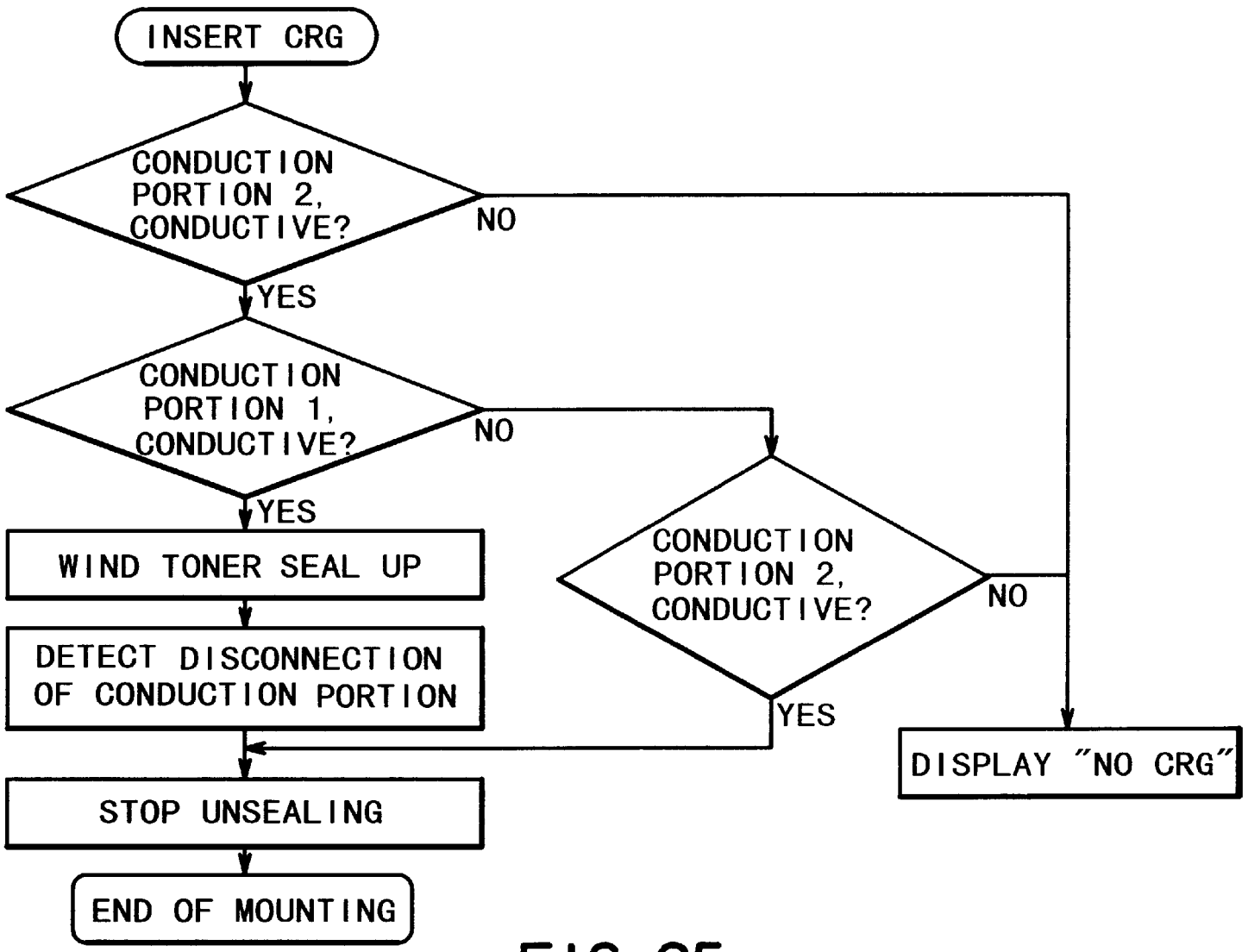
FIG. 25 is a flow chart for the third embodiment.
Figure 26:
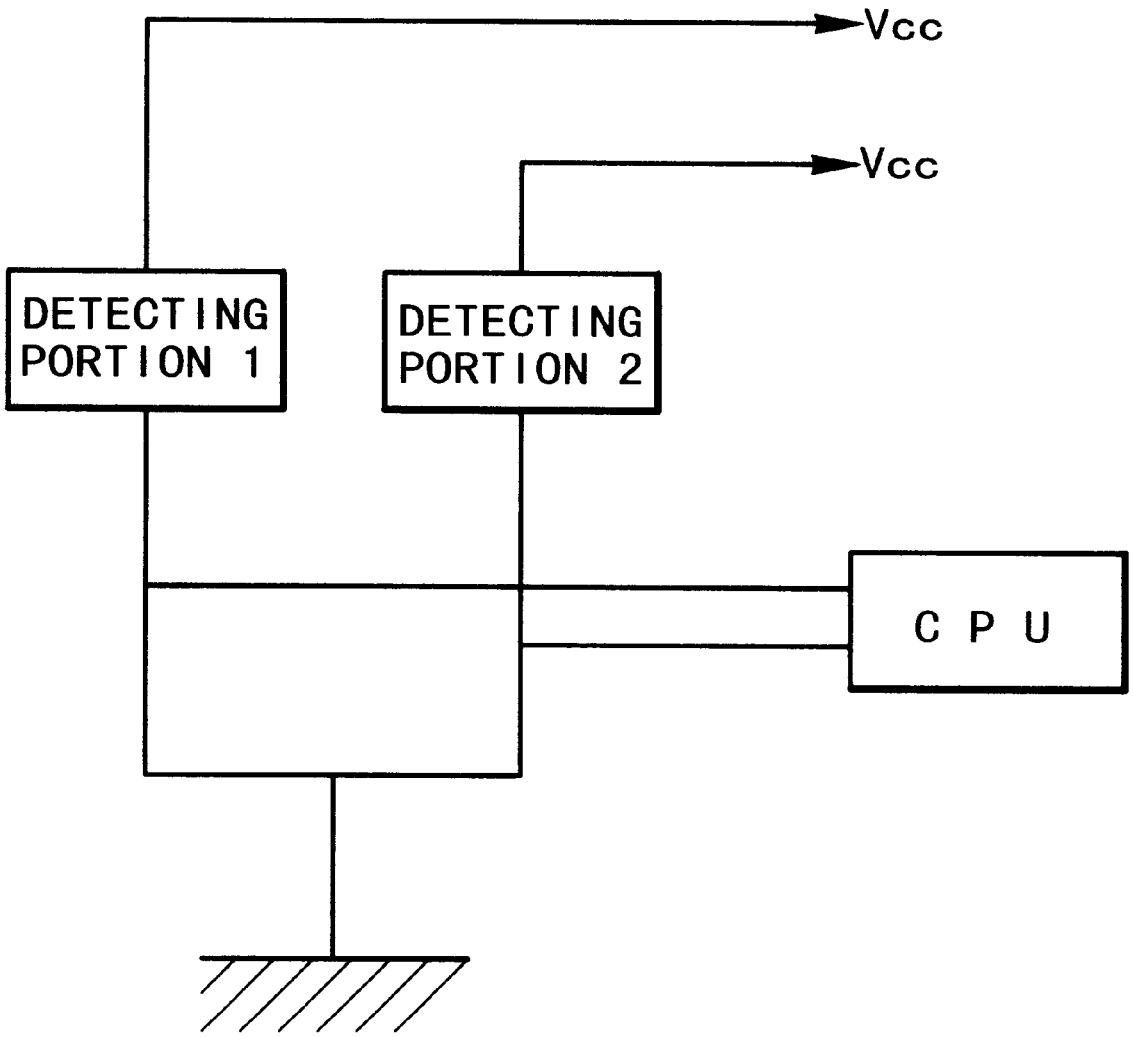
FIG. 26 is an abbreviated circuit diagram for detecting the toner seal, in the third embodiment.

FIG. 25 is a flow chart of the foregoing operation, and FIG. 26 schematically shows a circuit of the main assembly of the image forming apparatus. After the developer accommodating container of this example is mounted on the main assembly of the image forming apparatus, the detection portion 2 detects whether the mounting detection electroconductive portion (electroconductive portion 2) is conductive or not, if not, "no container" is displayed on the main assembly. If it is conductive, the detection portion 1 detects or discriminates whether the unsealing detection electroconductive portion(electroconductive portion 1) is conductive or not, and if not, the conduction of the electroconductive portion 2 is checked, and if it is not conductive, the same display is made on the same assembly, and if it is conductive, completion of unsealing of the toner seal is discriminated. When the electroconductive portion 1 is conductive, the winding of the toner seal is started, and the end of the unsealing is discriminated when the unsealing is detected upon the cut of the electroconductive portion 1. The detection portions 1 and 2 may be the same as the detecting means 25 of FIG. 6.

By disposing the end side X1 of the end of the heat welded portion X of the seal member relative to the developer accommodating container between the unsealing detection electroconductive portion and the mounting detection electroconductive portion as shown in FIG. 16, seal pulling can be stopped before removing the end X1. Therefore, similar to Embodiment 2, there is no need for removing the end portion of the heat welded portion, so that a decrease of the unsealing strength can be accomplished.

The mounting detection electroconductive portion is effective to detect correct mounting of the main body of the developer accommodating container, the developing device or the process cartridge which incorporates the developer accommodating container, relative to the image forming apparatus. Particularly, when the developer seal is wound up, the winding shaft (unshown) disposed adjacent the end of the seal and the mounting detection electroconductive portion are close to each other, and therefore, the correct mounting position can be assured with higher certainty than in the connection between the winding shaft and the driving gear.

In this example, the unsealing detection position and the mounting detection position are close to each other on the developer seal, and therefore, as described hereinbefore, the contact portion can be shared partly, and simultaneous assembling is possible, with the advantage in terms of assembling and manufacturing cost.

In this example, the unsealing confirmation tests of the developer accommodating container using the developer sealing member have been carried out, and it has been confirmed that unsealing strength of the electroconductive portion is as small as 0.2–0.3 kgf including the developer seal per se, and that unsealing detection is stable.

The mounting detection function is sufficient, and when the developer accommodating container is obliquely or inclinedly mounted, the conduction at the mounting detection portion is not established so that operation of the main assembly of the image forming apparatus including the driving of the winding shaft can be stopped, and damage of the winding shaft and the gear such as can be avoided.

(Embodiment 4)

This example is similar to Embodiment 2, but the electroconductive portion for the unsealing detection is formed on the seal base by aluminum evaporation. The used developer seal, the developer accommodating container, the configuration pattern of the electroconductive portion 26, are the same as with Embodiment 2. Metal aluminum is evaporated on the polyester layer (surface layer) into a thickness of 600 angstrom to provide an electroconductive portion 26. The electric resistance value of the electroconductive portion is approximately 10 Ω, and the unsealing detection was correctly performed.

In the case of evaporation, the film thickness can be small; the material cost is low, the tearing force is small; and the positional accuracy of assembling can be easily enhanced, although the cost for the manufacturing apparatus, including masking for the evaporation pattern formation, is high.

In this example, aluminum evaporation is carried out, and it has been confirmed that electric resistance and the tearing force or the like is satisfactory, using copper, nickel, or the like.

Using this example, the unsealing confirmation tests of the developer accommodating container using the developer sealing member have been carried out, and the unsealing strength of the electroconductive portion is slightly low (0.1–0.2 kgf), and therefore, it is satisfactory. It has been also confirmed that unsealing detection is correct.

This example can be incorporated in Embodiment 3. Even if the electroconductive portions for the unsealing detection and the mounting detection of Embodiment 3 are formed using aluminum evaporation, the results are satisfactory.

(Embodiment 5)

This example is similar to Embodiment 2, but the electroconductive portion for the unsealing detection is composed of carbon coating. The used developer seal, the developer accommodating container, the configuration pattern of the electroconductive portion 26, are the same as with Embodiment 2. More particularly, film is coated with material made of carbon black (ketchen black EC), thermoplastic elastomer (binder) (more particularly styrene and ethylene butylene block copolymer resin material), dispersed and mixed in toluene (solvent), which material is applied on the film and dried.

In this example, film formation and film thickness of the coating (including tearing strength) and adjustment of the electric resistance value, are important. More particularly, in order to firmly form the coating film, it is good to increase the amount of the binder, but if the amount of carbon is reduced correspondingly, the electric resistance value becomes large. As regards the film thickness of the coating, it is preferably as small as possible to decrease the tearing force, but reduction thereof results in the decrease of the amount or content of the carbon, and therefore, the electric resistance value increases. If the carbon content is increased in an attempt to prevent it, the formation of the coating film becomes difficult (poor circulation), so proper selection of the materials and the coating thickness are desired.

In this example, thermoplastic elastomer 100 parts and carbon black 50 parts are mixed and dispersed in toluene solvent. The material is applied into a film thickness of 30 μm. The electric resistance value was approximately 100 Ω, which is usable. In order to decrease the electric resistance value, the addition of carbon black was doubled, but no good film was formed.

In this example, unsealing confirmation tests have been carried out for the developer accommodating container using the developer sealing member, and it has been confirmed that unsealing strength of the electroconductive portion is high, not less than 0.5 kgf, and as regards the unsealing detection, it is possible, but the detection performance is relatively slightly poor. Similarly to Embodiment 4, the example is applicable to Embodiment 3. More particularly, even if the electroconductive portion of the unsealing detection and the mounting detection of Embodiment 3 is formed of the carbon coating, the practicable effects are provided.

(Embodiment 6)

This example is similar to Embodiment 2, but the electroconductive member covers the entire surface of the developer seal. More particularly, aluminum foil is bonded on the entire surface of the polyester layer (surface layer) shown by 21*i* in FIG. 8. The seal structure and the developer accommodating container or the like except for the polyester layer are the same as with Embodiment 2. In this example, the aluminum foil is bonded or pasted on the whole surface, the electric resistance is lower than in Embodiment 2 and is stable at a low level, thus assuring the unsealing detection. Additionally, as regards the contact with the contact of the developing device or developer hopper or the like, which is a receptor of the developer accommodating container, the latitude of the alignment is expanded. (the contact portion may be provided at any position of 21*m* and 21*n* in FIG. 17). Additionally, it is pasted on all the surface, the assembling in the seal manufacturing is easy, and therefore, the manufacturing cost is low.

Figure 17:
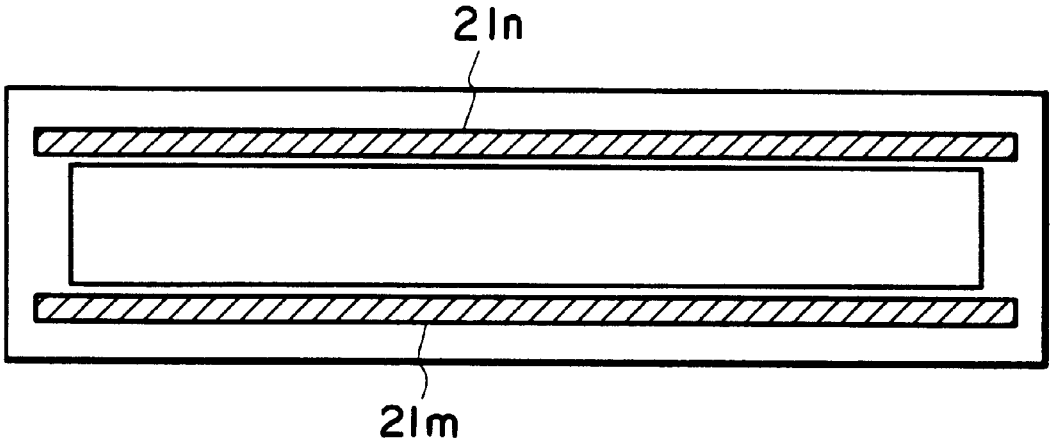
FIG. 17 is a plan view of the toner seal after the completion of the toner seal removal in the sixth embodiment of the present invention.

On the contrary, when the seal member of this example is used, it is necessary to tear and remove the film upon unsealing. If the tearing stops before completion, the conduction is provided by the remaining portion. Thus, the unsealing detection does not operate. As shown in FIG. 17, when the film is completely pulled and removed, the conduction is cut between 21*m* and 21*n*.

Upon the unsealing operation, as contrasted to Embodiment 2, the unsealing strength (force required for the unsealing) tends to be high, since the aluminum foil is added to the whole surface of the film.

The unsealing confirmation tests have been carried out for the developer accommodating container using the developer sealing member of this example, and it has been confirmed that unsealing strength of the electroconductive portion is approximately 0.5 kgf, which is slightly higher than with Embodiment 2, but as regards the unsealing detection, the electric resistance value of the electroconductive portion is very low, i.e., not more than 1 Ω, and no problem has been confirmed.

The forming method of the electroconductive portion in this example may be that of Embodiment 4 (evaporation of aluminum or the like) or carbon coating (Embodiment 5). In view of the masking or part coating during evaporation, the manufacturing is easier in this embodiment. And the manufacturing cost will be low.

(Embodiment 7)

This is similar to Embodiment 2, but the developer seal comprises a cover film for sealing the developer discharging opening used in Embodiment 1 and a tear tape, lined on the cover film, which permits tearing of the cover film to form the opening. The structures of the developer accommodating container and the electroconductive portion for the unsealing detection, the fixing method on the seal member or the like are the same as with Embodiment 2.

Figure 18:
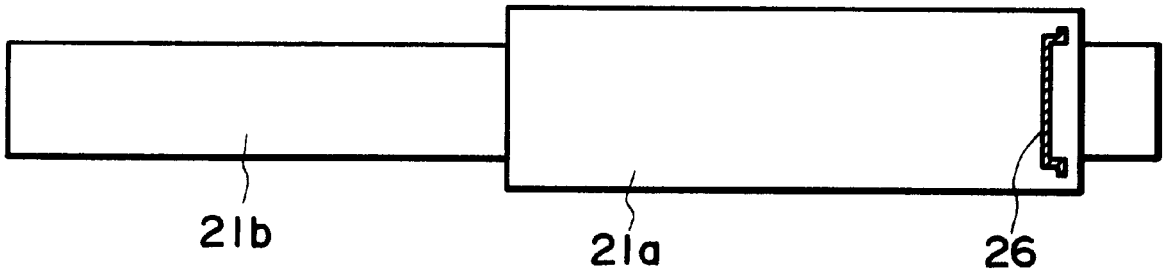
FIG. 18 is a plan view of the toner seal in the seventh embodiment of the present invention, and depicts the structure thereof.
Figure 19:
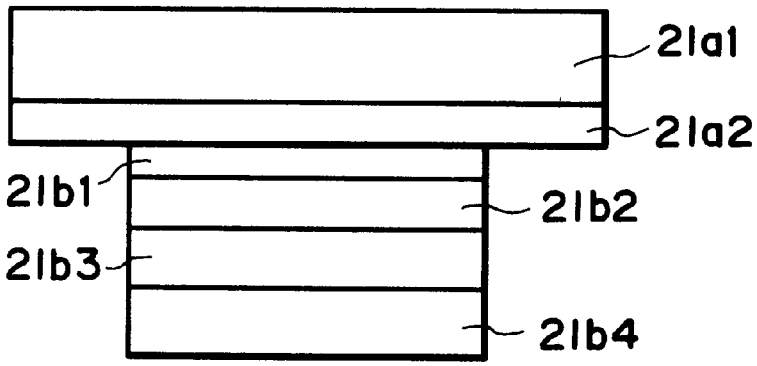
FIG. 19 is a vertical cross section of the toner seal in the second embodiment of the present invention, and depicts the laminar structure thereof.

The seal member of this example is shown in FIGS. 18, 19.

As regards the cover film and the tear tape used in Embodiment 1, the layer structure preferably comprises:

the cover film 21*a* for sealing the developer discharging opening comprising:

Expanded polypropylene foam 140 μm (21*a*1); and

EVA sealant 20 μm (21*a*2).

and the tear tape 21*b* for forming the opening preferably comprises the layer structure of the following:

Polyester 16 μm (21*b*1);

Expanded Nylon 25 μm(21*b*2);

Low density polyethylene 30 μm (21*b*3); and

EVA sealant 40 μm (21*b*4).

The cover film and the tear tape are unified by welding to provide a seal member (between 21*a*2 and 21*b*1), and similar to Embodiment 1, it is heat-welded to the edge portion of the opening of the developer accommodating container. As shown in FIG. 18, aluminum foil is pasted on the surface of the seal as an electroconductive portion 26, similar to Embodiment 2.

By pulling the tear tape in the fold-back direction as in Embodiment 1, the cover film is torn along the width of the tear tape. Similar to Embodiment 2, the unsealing advances until the electroconductive portion, provided at the end of the developer discharging opening, is torn with the cover film, and the electroconductive portion is cut, so that conduction is prevented, thus permitting the detection of unsealing.

The unsealing confirmation tests have been carried out for the developer accommodating container using the developer sealing member of this example, and it has been confirmed that unsealing strength of the electroconductive portion is 0.2–0.3 kgf, which is substantially equivalent to Embodiment 2, and the unsealing detection is the same, since the structure is the same as Embodiment 2.

The seal member of this example is usable with Embodiments 2–6, and there is no practical problem.

(Embodiment 8)

Figure 27:
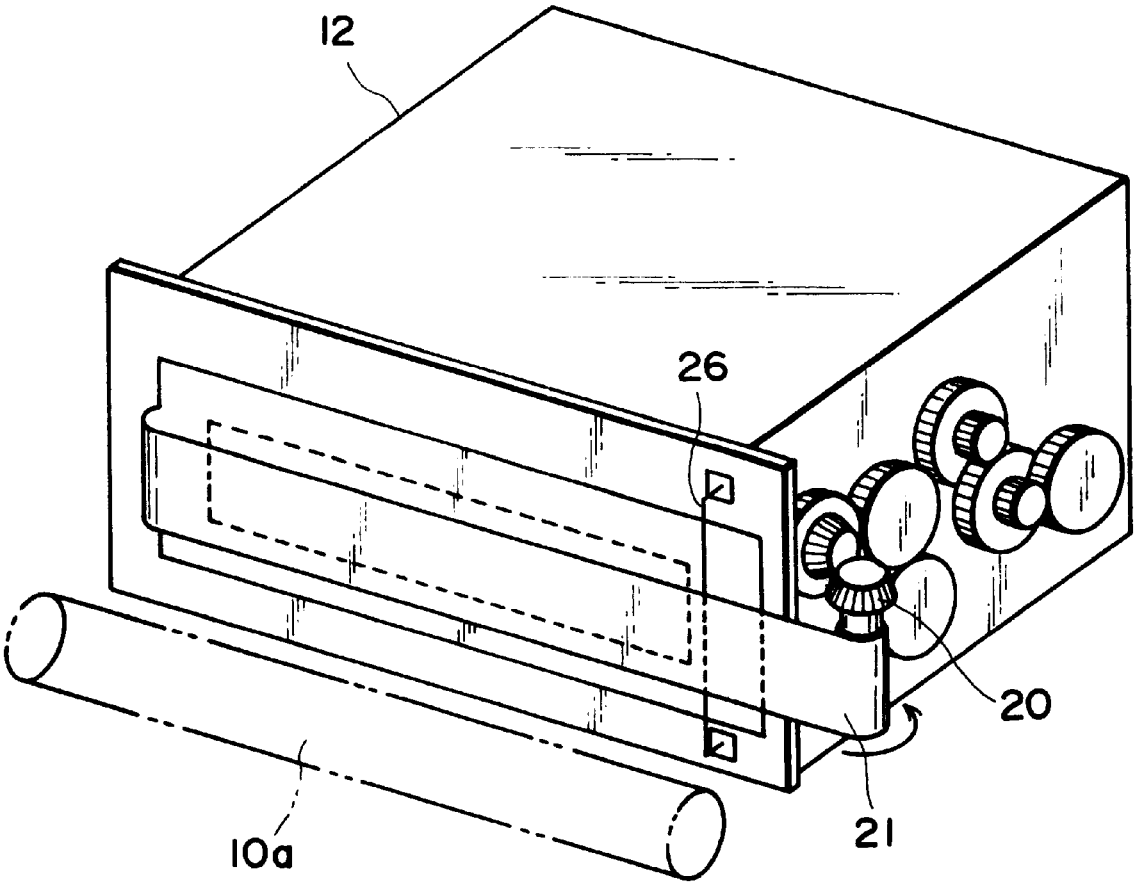
FIG. 27 is a perspective view of the developer container in the eighth embodiment of the present invention, to which the toner seal has been fixed after the filling of the developer into the developer container.

FIG. 27 shows the assembled state of the developer accommodating container of this example.

In this example, the use is made with aluminum foil 30 μm as an electroconductive member for the unsealing detection of the developer seal, but as shown in FIG. 27, it is not pasted on the developer seal, and the electroconductive member and the seal are separated from each other. The other structure of the developer seal or the like is the same as with Embodiment 2.

The width of the foil is 1 mm (ribbon-like).

In this example, the electroconductive member is extended in the form of arch over the developer seal. Upon the unsealing, the developer seal is pulled, and the electroconductive member provided adjacent the end of the developer discharging opening is cut while winding it, thus permitting detection of the unsealing.

According to this embodiment, since there is no need of fixing the electroconductive member to the developer seal, the required condition for the seal manufacturing is free. So, any member is usable, and therefore, the latitude in the design is expanded, but the material is selected in view of the low electric resistance value and easy cutting similar to Embodiment 2.

The unsealing confirmation tests have been carried out for the developer accommodating container of this example, and it has been confirmed that cutting strength of the electroconductive portion is 0.5 kgf, which is practically low enough, and the unsealing detection is in good order.

As a further alternative of this embodiment, the electroconductive member may be made of copper with the same effects.

However, the electric resistance value and the easy cutting are to be both satisfied, and for this reason, it has a diameter of 0.1 mm.

The unsealing confirmation tests have been carried out for the developer accommodating container of the example, and its has been confirmed that cutting strength of the electroconductive portion is 2 kgf, which is slightly high but practical, and the unsealing detection is in good order. In this example, too, if the foregoing conditions are satisfied, metal other than copper or another material is usable.

The developer accommodating container of the example is usable with Embodiment 3, and the unsealing detection portion and the mounting detection portion may be formed of electroconductive member away from the developer seal.

The developer seal in this example may be of the cover-film-plus tear tape type (Embodiment 7) or the easy peel type (Embodiment 1) (easy peel type is peeled off without tearing the seal).

In Embodiment 1 to Embodiment 8, the process cartridge detachably mountable to a main assembly of an image forming apparatus is provided with a developer accommodating container, but the developing device provided with a developer accommodating container may be detachably mountable, or the developer accommodating container is solely detachably mountable relative to the main assembly of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A seal member for sealing an opening of a developer accommodating container for accommodating a developer, which developer accommodating container is detachably mountable to a main assembly of an image forming apparatus, said seal member comprising:

a seal base for sealing the opening;

a force receiving portion for receiving a force for unsealing said seal base; and an electroconductive portion comprising a seal-member contact portion and a disconnectable portion connected to said seal-member contact portion when said seal base seals the opening and disconnected from said seal-member contact portion during unsealing of said seal base from the opening, wherein said seal-member contact portion is electrically connected to a main-assembly contact portion for the main assembly of the image forming apparatus when said developer accommodating container is mounted to the main assembly of the image forming apparatus, wherein the electrical connection between said seal-member contact portion and the main-assembly contact portion permits the main assembly to detect whether or not said seal-member contact portion and said seal-member disconnectable portion are connected to each other.

2. A seal member according to claim 1, wherein said electroconductive portion is provided on said seal base.

3. A seal member according to claim 2, wherein said electroconductive portion is composed of metal foil.

4. A seal member according to claim 2, wherein said electroconductive portion is composed of metal evaporated on said seal base.

5. A seal member according to claim 1, wherein said seal member is provided with a second electroconductive portion for detecting whether the developer accommodating container is mounted to a predetermined position of the main assembly of said image forming apparatus, and said electroconductive portion is disconnected while said second electroconductive portion is not disconnected by the unsealing operation of said seal base.

6. A seal member according to claim 5, wherein said second electroconductive portion is disposed downstream of said electroconductive portion with respect to an unsealing direction of said seal base.

7. A seal member according to claim 1, wherein said electroconductive portion is longer than said opening in a direction crossing with an unsealing direction of said seal base.

8. A seal member according to claim 1, wherein the electroconductive portion is composed of carbon, silver, copper, nickel or aluminum.

9. A seal member according to claim 1, wherein said seal member is subjected to a laser machining process at a portion along which it is cut.

10. A seal member according to claim 1, wherein said seal member has a tear tape for tearing said seal base, the tear tape being provided on a back side of said seal base.

11. A seal member according to claim 1, wherein said electroconductive portion is provided so as to cover substantially the entire surface of the opening.

12. A seal member according to claim 1, wherein said electroconductive portion comprises a second seal-member contact portion and a second disconnectable portion connected to said second seal-member contact portion when said seal base seals the opening and is disconnected from said second seal-member contact portion during unsealing of said seal base from the opening, wherein said second seal-member contact portion is electrically connected to a main-assembly contact portion for the main-assembly of the image forming apparatus when said developer accommodating container is mounted to the main assembly of the image forming apparatus, wherein the electrical connection between said second seal-member contact portion and the main-assembly contact portion permits the main assembly to detect whether or not said second seal-member contact portion and said disconnectable portion are connected to each other.

13. A seal member according to claim 1, wherein said developer accommodating container is contained as a unit in a developing apparatus.

14. A seal member according to claim 1, wherein said developer accommodating container is contained as a unit in a process cartridge.

15. A developer accommodating container for accommodating a developer, which developer accommodating container is detachably mountable to a main assembly of an image forming apparatus, said developer accommodating container comprising:

an opening;

a seal member for sealing said opening, said seal member including a seal base for sealing said opening and a force receiving portion for receiving a force for unsealing said seal base; and an electroconductive portion comprising a seal-member contact portion and a disconnectable portion connected to said seal-member contact portion when said seal base seals the opening and disconnected from said seal-member contact portion during unsealing of said seal base from the opening, wherein said seal-member contact portion is electrically connected to a main-assembly contact portion for the main assembly of the image forming apparatus when said developer accommodating container is mounted to the main assembly of the image forming apparatus, wherein the electrical connection between said seal-member contact portion and the main-assembly contact portion permits the main assembly to detect whether or not said seal-member contact portion and said seal-member disconnectable portion are connected to each other.

16. A container according to claim 15, wherein said seal member is provided with said electroconductive portion.

17. A container according to claim 16, wherein said electroconductive portion is provided so as to cover substantially the entire surface of the opening.

18. A container according to claim 15, wherein said electroconductive portion is provided on said seal base.

19. A container according to claim 18, wherein said electroconductive portion is composed of metal foil.

20. A container according to claim 18, wherein said electroconductive portion is composed of metal evaporated on said seal base.

21. A container according to claim 15, wherein said seal member is provided with a second electroconductive portion for detecting whether said developer accommodating container is mounted to a predetermined position of the main assembly of said image forming apparatus, and said electroconductive portion is disconnected while said second electroconductive portion is not disconnected by the unsealing operation of said seal base.

22. A container according to claim 21, wherein said second electroconductive portion is disposed downstream of said electroconductive portion with respect to an unsealing direction of said seal base.

23. A container according to claim 15, wherein said electroconductive portion is longer than said opening in a direction crossing with an unsealing direction of said seal base.

24. A container according to claim 15, wherein the electroconductive portion is composed of carbon, silver, copper, nickel or aluminum.

25. A container according to claim 15, wherein said seal member is subjected to a laser machining process at a portion along which it is cut.

26. A container according to claim 15, wherein said seal member has a tear tape for tearing said seal base, the tear tape being provided on a back side of said seal base.

27. A container according to claim 15, further comprising transmitting means for transmitting the force to said force receiving portion.

28. A container according to claim 27, wherein said transmitting means is provided with a winding up portion for winding said seal base up.

29. A container according to claim 15, wherein information relating to a lifetime of said developer accommodating container is stored by the main assembly of said image forming apparatus, and the information is reset when it is detected that said electroconductive portion is not disconnected, when said developer accommodating container is mounted to the main assembly of said image forming apparatus.

30. A container according to claim 29, wherein the information remains unchanged when it is detected that said electroconductive portion is disconnected when said developer accommodating container is mounted to the main assembly of said image forming apparatus.

31. A developing apparatus for developing with a developer an electrostatic image formed on an image bearing member, which developing apparatus is detachably mountable to a main assembly of an image forming apparatus, said developing apparatus comprising:

a developing container having a developer carrying member for carrying the developer at a developing position for developing the electrostatic image;

a developer accommodating container for accommodating the developer, wherein an opening is provided between said developer accommodating container and said developing container to permit the discharge of the developer from said developer accommodating container to said developing container;

a seal member for sealing said opening, said seal member including a seal base for sealing said opening and a force receiving portion for receiving a force for unsealing said seal base; and an electroconductive portion comprising a seal-member contact portion and a disconnectable portion connected to said seal-member contact portion when said seal base seals the opening and disconnected from said seal-member contact portion during unsealing of said seal base from the opening, wherein said seal-member contact portion is electrically connected to a main-assembly contact portion for the main assembly of the image forming apparatus when said developer accommodating container is mounted to the main assembly of the image forming apparatus, wherein the electrical connection between said seal-member contact portion and the main-assembly contact portion permits the main assembly to detect whether or not said seal-member contact portion and said seal-member disconnectable portion are connected to each other.

32. An apparatus according to claim 31, wherein said seal member is provided with said electroconductive portion.

33. An apparatus according to claim 32, wherein said electroconductive portion is provided so as to cover substantially the entire surface of the opening.

34. An apparatus according to claim 31, wherein said electroconductive portion is provided on said seal base.

35. An apparatus according to claim 34, wherein said electroconductive portion is composed of metal foil.

36. An apparatus according to claim 34, wherein said electroconductive portion is composed of metal evaporated on said seal base.

37. An apparatus according to claim 31, wherein said seal member is provided with a second electroconductive portion for detecting whether said developer accommodating container is mounted to a predetermined position of the main assembly of said image forming apparatus, and said electroconductive portion is disconnected while said second electroconductive portion is not disconnected by the unsealing operation of said seal base.

38. An apparatus according to claim 37, wherein said second electroconductive portion is disposed downstream of said electroconductive portion with respect to an unsealing direction of said seal base.

39. An apparatus according to claim 31, wherein said electroconductive portion is longer than said opening in a direction crossing with an unsealing direction of said seal base.

40. An apparatus according to claim 31, wherein the electroconductive portion is composed of carbon, silver, copper, nickel or aluminum.

41. An apparatus according to claim 31, wherein said seal member is subjected to a laser machining process at a portion along which it is cut.

42. An apparatus according to claim 31, wherein said seal member has a tear tape for tearing said seal base, the tear tape being provided on a back side of said seal base.

43. An apparatus according to claim 31, further comprising transmitting means for transmitting the force to said force receiving portion.

44. An apparatus according to claim 43, wherein said transmitting means is provided with a winding up portion for winding said seal base up.

45. An apparatus according to claim 43, wherein information relating to a lifetime of said developer accommodating container is stored by the main assembly of said image forming apparatus, and the information is reset when it is detected that said electroconductive portion is not disconnected, when said developer accommodating container is mounted to the main assembly of said image forming apparatus.

46. An apparatus according to claim 45, wherein the information remains unchanged when it is detected that said electroconductive portion is disconnected when said developer accommodating container is mounted to the main assembly of said image forming apparatus.

47. A process cartridge detachably mountable to a main assembly of an image forming apparatus, said process cartridge comprising:

an image bearing member;

a developing device for developing with a developer an electrostatic image formed on said image bearing member, said developing device including a developing container provided with a developer carrying member for carrying the developer to a developing position for developing the electrostatic image, a developer accommodating container for accommodating the developer, wherein an opening is provided between said developer accommodating container and said developing container to permit discharge of the developer from said developer accommodating container to said developing container;

a seal member for sealing said opening, said seal member including a seal base for sealing said opening and a force receiving portion for receiving a force for unsealing said seal base; and an electroconductive portion comprising a seal-member contact portion and a disconnectable portion connected to said seal-member contact portion when said seal base seals the opening and disconnected from said seal-member contact portion during unsealing of said seal base from the opening, wherein said seal-member contact portion is electrically connected to a main-assembly contact portion for the main assembly of the image forming apparatus when said developer accommodating container is mounted to the main assembly of the image forming apparatus, wherein the electrical connection between said seal-member contact portion and the main-assembly contact portion permits the main assembly to detect whether or not said seal-member contact portion and said seal-member disconnectable portion are connected to each other.

48. A process cartridge according to claim 47, wherein said seal member is provided with said electroconductive portion.

49. A process cartridge according to claim 48, wherein said electroconductive portion is provided so as to cover substantially the entire surface of the opening.

50. A process cartridge according to claim 47, wherein said electroconductive portion is provided on said seal base.

51. A process cartridge according to claim 50, wherein said electroconductive portion is composed of metal foil.

52. A process cartridge according to claim 50, wherein said electroconductive portion is composed of metal evaporated on said seal base.

53. A process cartridge according to claim 47, wherein said seal member is provided with a second electroconductive portion for detecting whether said developer accommodating container is mounted to a predetermined position of the main assembly of said image forming apparatus, and said electroconductive portion is disconnected while said second electroconductive portion is not disconnected by the unsealing operation of said seal base.

54. A process cartridge according to claim 53, herein said second electroconductive portion is disposed downstream of said electroconductive portion with respect to an unsealing direction of said seal base.

55. A process cartridge according to claim 47, wherein said electroconductive portion is longer than said opening in a direction crossing with an unsealing direction of said seal base.

56. A process cartridge according to claim 47, wherein the electroconductive portion is composed of carbon, silver, copper, nickel or aluminum.

57. A process cartridge according to claim 47, wherein said seal member is subjected to a laser machining process at a portion along which it is cut.

58. A process cartridge according to claim 47, wherein said seal member is provided on a back side of said seal base, and has a tear tape for tearing said seal base.

59. A process cartridge according to claim 47, further comprising transmitting means for transmitting the force to said force receiving portion.

60. A process cartridge according to claim 59, wherein said transmitting means is provided with a winding up portion for winding said seal base up.

61. A process cartridge according to claim 47, wherein information relating to a lifetime of said developer accommodating container is stored by the main assembly of said image forming apparatus, and the information is reset when it is detected that said electroconductive portion is not disconnected, when said developer accommodating container is mounted to the main assembly of said image forming apparatus.

62. A process cartridge according to claim 61, wherein the information remains unchanged when it is detected that said electroconductive portion is disconnected when said developer accommodating container is mounted to the main assembly of said image forming apparatus.

63. A process cartridge according to claim 47, wherein said image bearing member is an electrophotographic photosensitive member.

64. An image forming apparatus having a main assembly to which a developer accommodating container for accommodating a developer is detachably mountable, said developer accommodating container including an opening, a seal member, having a seal base for sealing the opening, a force receiving portion for receiving a force for unsealing said seal base, an electroconductive portion comprising a seal-member contact portion and a disconnectable portion connected to said seal-member contact portion when said seal base seals the opening and disconnected from said seal-member contact portion during unsealing of said seal base from the opening, wherein said seal-member contact portion is electrically connected to a main-assembly contact portion for the main assembly of the image forming apparatus when said developer accommodating container is mounted to the main assembly of the image forming apparatus, wherein the electrical connection between said seal-member contact portion and the main-assembly contact portion permits the main assembly to detect whether or not said seal-member contact portion an said seal-member disconnectable portion are connected to each other, said image forming apparatus comprising:

a main-assembly contact portion electrically connectable with the seal-member contact portion of the electroconductive portion; and detecting means, electrically connected with said main-assembly contact portion, for detecting whether the electroconductive portion is disconnected or not.

65. An apparatus according to claim 64, wherein said seal member is provided with a second electroconductive portion for detecting whether said developer accommodating container is mounted to a predetermined position of the main assembly of said image forming apparatus, and said electroconductive portion is disconnected while said second electroconductive portion is not disconnected by the unsealing operation of said seal base, wherein said image forming apparatus further comprises detecting means for detecting whether said developer accommodating container is mounted to a predetermined position of the main assembly of said image forming apparatus on the basis of electrical connection with said second electroconductive portion.

66. An apparatus according to claim 64, further comprising driving means for applying said force for unsealing said seal base to said force receiving portion.

67. An apparatus according to claim 64, wherein information relating to a lifetime of said developer accommodating container is stored by the main assembly of said image forming apparatus, and the information is reset when it is detected that said electroconductive portion is not disconnected, when said developer accommodating container is mounted to the main assembly of said image forming apparatus.

68. An apparatus according to claim 67, wherein the information remains unchanged when it is detected that said electroconductive portion is disconnected when said developer accommodating container is mounted to the main assembly of said image forming apparatus.

69. An apparatus according to claim 64, further comprising a developing device for developing an electrostatic image on an image bearing member and which is detachably mountable relative to the main assembly of said image forming apparatus, said developing device being provided with said developer accommodating container.

70. An apparatus according to claim 64, further comprising a process cartridge detachably mountable to the main assembly and which includes an image bearing member and a developing device for developing an electrostatic image on the image bearing member, wherein said developing device is provided with said developer accommodating container.

71. An apparatus according to claim 64, further comprising an image bearing member which is an electrophotographic photosensitive member.

72. A seal member for sealing an opening of a developer accommodating container for accommodating a developer, which developer accommodating container is detachably mountable to a main assembly of an image forming apparatus, said seal member comprising:

a seal base for sealing the opening;

a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to detect whether the electroconductive portion is disconnected or not, wherein said electroconductive portion is disposed adjacent an ending portion where the unsealing operation of said seal base ends.

73. A developer accommodating container for accommodating a developer, which developer accommodating container is detachably mountable to a main assembly of an image forming apparatus, said developer accommodating container comprising:

an opening;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to detect whether the electroconductive portion is disconnected or not, wherein said electroconductive portion is disposed adjacent an ending portion where the unsealing operation of said seal base ends.

74. A developing apparatus for developing with a developer an electrostatic image formed on an image bearing member, which developing apparatus is detachably mountable to a main assembly of an image forming apparatus, said developing apparatus comprising:

a developing container having a developer carrying member for carrying the developer at a developing position for developing the electrostatic image;

a developer accommodating container for accommodating the developer, wherein an opening is provided between said developer accommodating container and said developing container to permit the discharge of the developer from said developer accommodating container to said developing container;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to permit the main assembly of the image forming apparatus to detect whether the electroconductive portion is disconnected or not, wherein said electroconductive portion is disposed adjacent an ending portion where the unsealing operation of said seal base ends.

75. A process cartridge detachably mountable to a main assembly of an image forming apparatus, said process cartridge comprising:

an image bearing member;

a developing device for developing with a developer an electrostatic image formed on said image bearing member, said developing device including a developing container provided with a developer carrying member for carrying the developer to a developing position for developing the electrostatic image, a developer accommodating container for accommodating the developer, wherein an opening is provided between said developer accommodating container and said developing container to permit discharge of the developer from said developer accommodating container to said developing container;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to permit the main assembly of the image forming apparatus to detect whether the electroconductive portion is disconnected or not, wherein said electroconductive potion is disposed adjacent an ending portion where the unsealing operation of said seal base ends.

76. An image forming apparatus having a main assembly to which a developer accommodating container for accommodating a developer is detachably mountable, said developer accommodating container including an opening, a seal member, having a seal base for sealing the opening, a force receiving portion for receiving a force for unsealing said seal base, an electroconductive portion disconnectable by an unsealing operation of said seal base, said image forming apparatus comprising:

a second contact portion electrically connectable with a first contact portion of the electroconductive portion; and detecting means, electrically connected with said second contact portion, for detecting whether the electroconductive portion is disconnected or not, wherein said electroconductive portion is disposed adjacent an ending portion where the unsealing operation of said seal base ends.

77. A seal member for sealing an opening of a developer accommodating container for accommodating a developer, which developer accommodating container is detachably mountable to a main assembly of an image forming apparatus, said seal member comprising:

a seal base for sealing the opening;

a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to detect whether the electroconductive portion is disconnected or not, wherein the contact portion of said electroconductive portion is stationary when said electroconductive portion is disconnected by the unsealing operation of said seal base.

78. A developing accommodating container for accommodating a developer, which developer accommodating container is detachably mountable to a main assembly of an image forming apparatus, said developer accommodating container comprising:

an opening;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to permit the main assembly of the image forming apparatus to detect whether the electroconductive portion is disconnected or not, wherein the contact portion of said electroconductive portion is stationary when said electroconductive portion is disconnected by the unsealing operation of said seal base.

79. A developing apparatus for developing with a developer an electrostatic image formed on an image bearing member, which developing apparatus is detachably mountable to a main assembly of an image forming apparatus, said developing apparatus comprising:

a developing container having a developer carrying member for carrying the developer at a developing position for developing the electrostatic image;

a developer accommodating container for accommodating the developer, wherein an opening is provided between said developer accommodating container and said developing container to permit the discharge of the developer from said developer accommodating container to said developing container;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to permit the main assembly of the image forming apparatus to detect whether the electroconductive portion is disconnected or not, wherein the contact portion of said electroconductive portion is stationary when said electroconductive portion is disconnected by the unsealing operation of said seal base.

80. A process cartridge detachably mountable to a main assembly of an image forming apparatus, said process cartridge comprising:

an image bearing member;

a developing device for developing with a developer an electrostatic image formed on said image bearing member, said developing device including a developing container provided with a developer carrying member for carrying the developer to a developing position for developing the electrostatic image, a developer accommodating container for accommodating the developer, wherein an opening is provided between said developer accommodating container and said developing container to permit discharge of the developer from said developer accommodating container to said developing container;

a seal member for sealing said opening, said seal member including a seal base for sealing said opening and a force receiving portion for receiving a force for unsealing said seal base; and an electroconductive portion capable of being disconnected by an unsealing operation of said seal base, said electroconductive portion including a contact portion electrically connectable with a contact portion of the main assembly of the image forming apparatus to permit the main assembly of the image forming apparatus to detect whether the electroconductive portion is disconnected or not, wherein the contact portion of said electroconductive portion is stationary when said electroconduction portion is disconnected by the unsealing operation of said seal base.

81. An image forming apparatus having a main assembly to which a developer accommodating container for accommodating a developer is detachably mountable, said developer accommodating container including an opening, a seal member, having a seal base for sealing the opening, a force receiving portion for receiving a force for unsealing said seal base, an electroconductive portion disconnectable by an unsealing operation of said seal base, said image forming apparatus comprising:

a second contact portion electrically connectable with a first contact portion of the electroconductive portion; and detecting means, electrically connected with said second contact portion, for detecting whether the electroconductive portion is disconnected or not, wherein the contact portion of said electroconduction portion is stationary when said electroconduction portion is disconnected by the unsealing operation of said seal base.

82. An image forming apparatus having a main assembly to which a developer accommodating container for accommodating a developer is detachably mountable, said developer accommodating container including an opening, a seal member, having a seal base for sealing the opening, a force receiving portion for receiving a force for unsealing said seal base, an electroconductive portion disconnectable by an unsealing operation of said seal base, said image forming apparatus comprising:

a second contact portion electrically connectable with a first contact portion of the electroconductive portion; and detecting means, electrically connected with said second contact portion, for detecting whether the electroconductive portion is disconnected or not, wherein the stopping of the unsealing operation is determined on the basis of the disconnection of said electroconductive portion by the unsealing operation of said seal base.

83. A developer accommodating container for accommodating a developer, which developer accommodating container is detachably mountable to a main assembly of an image forming apparatus, said developer accommodating container comprising:

an opening;

a seal member including a seal base for sealing the opening, and a force receiving portion for receiving a force for unsealing said seal base; and an electroconductive portion comprising a first electroconductive portion disposed adjacent said seal member and a second electroconductive portion which is connected to said first electroconductive portion when said seal base seals the opening and is disconnected from said first electroconductive portion during unsealing of said base from the opening, wherein said first electroconductive portion is electrically connected to a main-assembly contact portion for the main assembly of the image forming apparatus when said developer accommodating container is mounted to the main assembly of the image forming apparatus, and wherein the electrical connection between said first electroconductive portion and the main-assembly contact portion permits the main assembly to detect whether or not said first electroconductive portion and said second electroconductive portion are connected to each other.

84. A container according to claim 83, wherein said seal member includes a first portion extending from said force receiving portion, and a second portion folded back and extending toward said force receiving portion, said second portion sealing said opening, and wherein said second electroconductive portion is disposed between said first and second portions of said seal member.

85. A developing apparatus for developing with a developer an electrostatic image formed on an image bearing member, which developing apparatus is detachably mountable to a main assembly of an image forming apparatus, said developing apparatus comprising:

a developing container having a developer carrying member for carrying the developer at a developing position for developing the electrostatic image;

a developer accommodating container for accommodating the developer, wherein an opening is provided between said developer accommodating container and said developing container to permit the discharge of the developer from said developer accommodating container to said developing container;

a seal member including a seal base for sealing the opening, and a force receiving portion for receiving a force for unsealing said seal base; and an electroconductive portion comprising a first electroconductive portion disposed adjacent said seal member and a second electroconductive portion which is connected to said first electroconductive portion when said seal base seals the opening and is disconnected from said first electroconductive portion during unsealing of said seal base from the opening, wherein said first electroconductive portion is electrically connected to a main-assembly contact portion for the main assembly of the image forming apparatus when said developer accommodating container is mounted to the main assembly of the image forming apparatus, and wherein the electrical connection between said first electroconductive portion and the main-assembly contact portion permits the main assembly to detect whether or not said first electroconductive portion and said second electroconductive portion are connected to each other.

86. A developing apparatus according to claim 85, wherein said seal member includes a first portion extending from said force receiving portion, and a second portion folded back and extending toward said force receiving portion, said second portion sealing said opening, and wherein said second electroconductive portion is disposed between said first and second portions of said seal member.

87. A process cartridge detachably mountable to a main assembly of an image forming apparatus, said process cartridge comprising:

an image bearing member;

a developing device for developing with a developer an electrostatic image formed on said image bearing member, said developing device including a developing container provided with a developer carrying member for carrying the developer to a developing position for developing the electrostatic image, a developer accommodating container for accommodating the developer, wherein an opening is provided between said developer accommodating container and said developing container to permit discharge of the developer from said developer accommodating container to said developing container;

a seal member including a seal base for sealing the opening, and a force receiving portion for receiving a force for unsealing said seal base; and an electroconductive portion comprising a first electroconductive portion disposed adjacent said seal member and a second electroconductive portion which is connected to said first electroconductive portion when said seal base seals the opening and is disconnected from said first electroconductive portion during unsealing of said seal base from the opening, wherein said first electroconductive portion is electrically connected to a main-assembly contact portion for the main assembly of the image forming apparatus when said developer accommodating container is mounted to the main assembly of the image forming apparatus, and wherein the electrical connection between said first electroconductive portion and the main-assembly contact portion permits the main assembly to detect whether or not said first electroconductive portion and said second electroconductive portion are connected to each other.

88. A process cartridge according to claim 87, wherein said seal member includes a first portion extending from said force receiving portion, and a second portion folded back and extending toward said force receiving portion, said second portion sealing said opening, and wherein said second electroconductive portion is disposed between said first and second portions of said seal member.

89. An image forming apparatus having a main assembly to which a developer accommodating container for accommodating a developer is detachably mountable, said developer accommodating container including an opening, a seal member including a seal base for sealing the opening, and a force receiving portion for receiving a force for unsealing said seal base, and an electroconductive portion comprising a first electroconductive portion disposed adjacent said seal member and a second electroconductive portion which is connected to said first electroconductive portion when said seal base seals the opening and is disconnected from said first electroconductive portion during unsealing of said seal base from the opening, wherein said first electroconductive portion is electrically connected to a main-assembly contact portion for the main assembly of the image forming apparatus when said developer accommodating container is mounted to the main assembly of the image forming apparatus, and wherein the electrical connection between said first electroconductive portion and the main-assembly contact portion permits the main assembly to detect whether or not said first electroconductive portion and said second electroconductive portion are connected to each other, said image forming apparatus comprising:

a main-assembly contact portion electrically connectable with first electroconductive portion of the electroconductive portion; and detecting means, electrically connected with said main-assembly contact portion, for detecting whether the second electroconductive portion is disconnected or not.

90. An image forming apparatus according to claim 89, wherein said seal member includes a first portion extending from said force receiving portion, and a second portion folded back and extending toward said force receiving portion, said second portion sealing said opening, and wherein said second electroconductive portion is disposed between said first and second portions of said seal member.

91. A method of sealing and unsealing an opening of a developer accommodating container for accommodating a developer, which developer accommodating container is detachably mountable to a main assembly of an image forming apparatus, and which opening is sealed by a seal member, said method comprising the steps of:

sealing the opening with a seal base member, wherein a seal-member contact portion and a disconnectable portion of the seal member are connected to each other when the opening is sealed and the seal-member contact portion is electrically connected to a main-assembly contact portion for the main assembly of the image forming apparatus when said developer accommodating container is mounted to the main assembly of the image forming apparatus;

receiving a force for unsealing the seal base; and unsealing the seal base and disconnecting the disconnectable portion from the seal-member contact portion, thereby causing the main assembly to detect the disconnecting of the seal-member contact portion and the seal-member disconnectable portion via the electrical connection between the seal-member contact portion and the main-assembly contact portion.

92. A method for accommodating developer comprising the steps of:

storing developer in a developer accommodating container detachably mountable to a main assembly of an image forming apparatus, the developer accommodating container having an opening;

sealing the opening with a seal base of a seal member, thereby sealing the developer in the developer accommodating container, wherein a seal-member contact portion and a disconnectable portion of the seal member are connected to each other when the opening is sealed and the seal-member contact portion is electrically connected to a main-assembly contact portion for the main assembly of the image forming apparatus when said developer accommodating container is mounted to the main assembly of the image forming apparatus;

receiving a force for unsealing the seal base; and unsealing the seal base and disconnecting the disconnectable portion from the seal-member contact portion, thereby causing the developer to flow out of the developer accommodating container and causing the main assembly to detect the disconnecting of the seal-member contact portion and the seal-member disconnectable portion via the electrical connection between the seal-member contact portion and the main-assembly contact portion.

93. A method for storing and carrying developer to an electrostatic image formed on an image bearing member with a developing apparatus that is detachably mountable to a main assembly of an image forming apparatus, said method comprising the steps of:

storing developer in a developer accommodating container of the developing apparatus, the developer accommodating container having an opening;

sealing the opening with a seal base of a seal member, thereby sealing the developer in the developer accommodating container, wherein a seal-member contact portion and a disconnectable portion of the seal member are connected to each other when the opening is sealed and the seal-member contact portion is electrically connected to a main-assembly contact portion for the main assembly of the image forming apparatus when said developer apparatus is mounted to the main assembly of the image forming apparatus;

receiving a force for unsealing the seal base;

unsealing the seal base and disconnecting the disconnectable portion from the seal-member contact portion;

causing the developer to flow out of the developer accommodating container through the opening; and carrying the developer from the opening to the image bearing member, wherein disconnecting the disconnectable portion from the seal-member contact portion causes the main assembly to detect the disconnecting of the seal-member contact portion and the seal-member disconnectable portion via the electrical connection between the seal-member contact portion and the main-assembly contact portion.

94. A method for developing, with developer, an electrostatic image formed on an image bearing member of a process cartridge, which is detachably mountable to a main assembly of an image forming apparatus, said method comprising the steps of:

storing developer in a developer accommodating container of the process cartridge, the developer accommodating container having an opening;

sealing the opening with a seal base of a seal member, thereby sealing the developer in the developer accommodating container, wherein a seal-member contact portion and a disconnectable portion of the seal member are connected to each other when the opening is sealed and the seal-member contact portion is electrically connected to a main-assembly contact portion for the main assembly of the image forming apparatus when the process cartridge is mounted to the main assembly of the image forming apparatus;

mounting the process cartridge in the main assembly of the image forming apparatus;

receiving a force from the image forming apparatus for unsealing the seal base;

unsealing the seal base and disconnecting the disconnectable portion from the seal-member contact portion;

moving the developer out of the developer accommodating container through the opening;

forming an electrostatic image on the image bearing member; and carrying the developer from the opening to the image bearing member to develop the electrostatic image thereon, wherein disconnecting the disconnectable portion from the seal-member contact portion causes the main assembly to detect the disconnecting of the seal-member contact portion and the seal-member disconnectable portion via the electrical connection between the seal-member contact portion and the main-assembly contact portion.

95. A method of detecting the disconnection of a seal-member contact portion and a disconnectable portion of an electroconductive portion of a seal member for sealing an opening of a developer accommodating container of a process cartridge detachably mounted to a main assembly of an image forming apparatus and for detecting the unsealing of the developer accommodating portion, said method comprising the steps of:

electrically connecting the seal-member contact portion and a main-assembly contact portion when the process cartridge is mounted to the main assembly of the image forming apparatus;

maintaining the electrical connection between the seal-member contact portion and the main-assembly portion when the disconnectable portion is disconnected from the seal-member contact portion during unsealing of the seal member from the developer accommodating container; and changing an electrical characteristic of the electrical connection between the seal-member contact portion and the main-assembly contact portion when the disconnectable portion is disconnected from the seal-member contact portion during unsealing of the seal member from the developer accommodating container, thereby permitting the main assembly to detect the unsealing of the seal member and the disconnection of the seal-member contact portion from the disconnectable portion.

96. A method of unsealing a seal member for sealing an opening of a developer accommodating container of a process cartridge detachably mounted to a main assembly of an image forming apparatus, the seal member comprising an electroconductive portion capable of being disconnected by an unsealing operation of a seal base of the seal member, the electroconductive portion including a contact portion electrically connectable with a contact portion of the main assembly of the image forming apparatus to detect whether the electroconductive portion is disconnected or not, said method comprising the step of:

unsealing the seal base of the seal member during the unsealing operation; and ending the unsealing operation of the seal base at an ending portion adjacent the electroconductive portion.

97. A method of unsealing a seal member for sealing an opening of a developer accommodating container of a process cartridge detachably mounted to a main assembly of an image forming apparatus, the seal member comprising an electroconductive portion capable of being disconnected by an unsealing operation of a seal base of the seal member, the electroconductive portion including a contact portion electrically connectable with a contact portion of the main assembly of the image forming apparatus to detect whether the electroconductive portion is disconnected or not, said method comprising the step of:

unsealing the seal base of the seal member and disconnecting the electroconductive portion during the unsealing operation; and maintaining the contact portion of the electroconductive portion stationary during the unsealing operation.

98. A method of unsealing a seal member for sealing an opening of a developer accommodating container of a process cartridge detachably mounted to a main assembly of an image forming apparatus, said method comprising the steps of:

unsealing a seal base of the seal member to unseal the developer accommodating container; and disconnecting first and second electroconductive portions of the seal member from each other as a result of unsealing the seal base while maintaining an electrical connection between the first electroconductive portion and a main-assembly contact portion of the main assembly when the process cartridge is mounted in the main assembly, wherein the electrical connection between the first electroconductive portion and the main-assembly contact portion permits the main assembly to detect whether or not said first electroconductive portion and said second electroconductive portion are connected to each other.

* * * * *

UNITED STATES PATENT AND TRADEMARK OFFICE

CERTIFICATE OF CORRECTION

PATENT NO. : 6,178,302 B1
DATED : January 23, 2001
INVENTOR(S) : Toshiaki Nagashima, et al.

It is certified that error appears in the above-identified patent and that said Letters Patent is hereby corrected as shown below:

Column 1,
Line 45, "unseal," should read -- unsealed, --.

Column 2,
Line 23, "FIGS. 6, (a)," should read -- FIGS. 6(a), --.

Column 5,
Line 45, "gear 10b" should read -- gear 10c --.
Line 58, "shaft" should read -- shaft 20 --.

Column 6,
Line 58, "FIGS.6, (a)," should read -- FIGS. 6(a), --.

Column 8,
Line 31, "tainer 12" should read -- tainer 12. --.
Line 38, "FIG. 8);" should read -- FIG. 8); and --.

Column 9,
Line 2, "remains" should read -- remain --.
Line 62, "capable" should read -- capable of --.

Column 11,
Line 39, "portion(electroconductive" should read -- portion (electroconductive --.

Column 13,
Line 46, "expanded." should read -- expanded --.

Column 14,
Line 26, "21a2)." should read -- 21a2), --.
Line 61, "the use is made with" should read -- the use is made of --.
Line 66, "structure" should read -- structures --, and "is" should read -- are Column 15,
Line 3, "of" should read -- of an --.

Column 16,
Line 55, "main-assembly": should read -- main assembly --.

UNITED STATES PATENT AND TRADEMARK OFFICE

CERTIFICATE OF CORRECTION

PATENT NO. : 6,178,302 B1
DATED : January 23, 2001
INVENTOR(S) : Toshiaki Nagashima, et al.

It is certified that error appears in the above-identified patent and that said Letters Patent is hereby corrected as shown below:

Column 20,
Line 35, "herein" should read -- herein --.

Column 21,
Line 26, "an" should read -- and --.

Column 23,
Line 37, "potion" should read -- portion --.

Column 28,
Line 18, "base" should read -- base of the seal --.

Column 30,
Lines 39 and 54, "step" should read -- steps --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*